US007603957B2

(12) United States Patent
Shiraishi

(10) Patent No.: US 7,603,957 B2
(45) Date of Patent: Oct. 20, 2009

(54) THREAD CUTTING DEVICE OF SEWING MACHINE

(75) Inventor: Atsushi Shiraishi, Tokyo (JP)

(73) Assignee: Juki Corporation, Tokyo (JP)

( * ) Notice: Subject to any disclaimer, the term of this patent is extended or adjusted under 35 U.S.C. 154(b) by 195 days.

(21) Appl. No.: 11/905,570

(22) Filed: Oct. 2, 2007

(65) Prior Publication Data

US 2008/0229989 A1 Sep. 25, 2008

(30) Foreign Application Priority Data

Oct. 3, 2006 (JP) ..... P.2006-271867
Oct. 3, 2006 (JP) ..... P.2006-271885

(51) Int. Cl.
*D05B 65/00* (2006.01)
*D05B 69/12* (2006.01)

(52) U.S. Cl. ..... 112/298; 112/300

(58) Field of Classification Search ..... 112/285, 112/288, 291, 296–301; 83/935–937, 949, 83/950

See application file for complete search history.

(56) References Cited

U.S. PATENT DOCUMENTS 3,141,432 A * 7/1964 Reeber et al. ..... 112/292
3,173,392 A * 3/1965 Hedegaard ..... 112/292
3,380,416 A * 4/1968 Du Buis et al. ..... 112/287
3,403,648 A * 10/1968 Jarrett ..... 112/130
3,470,835 A * 10/1969 Hoverter, Jr. et al. ..... 112/290
3,554,149 A * 1/1971 Diehm et al. ..... 112/287
4,138,958 A * 2/1979 Papajewski ..... 112/292
4,365,568 A * 12/1982 Ross ..... 112/291
5,964,170 A * 10/1999 Gries ..... 112/291
6,814,018 B1 * 11/2004 Chuo ..... 112/292

FOREIGN PATENT DOCUMENTS

JP 3106472 9/2000

* cited by examiner

*Primary Examiner*—Ismael Izaguirre
(74) *Attorney, Agent, or Firm*—Drinker Biddle & Reath LLP

(57) ABSTRACT

A thread cutting device includes a thread catching member having a catching portion, wherein the thread catching member moves back and forth across a path of a lower thread reeled out from a bobbin so as to catch the lower thread by the catching portion and cuts the lower thread by cooperating with a fixed knife, a first power transmitting portion which transmits a power to the thread catching member, a first cam member provided on a lower shaft rotated by a sewing machine motor and transmits a first moving force to the thread catching member through the first power transmitting portion, a second power transmitting portion which transmits a second moving force from a stepping motor to the thread catching member through the first power transmitting portion.

12 Claims, 20 Drawing Sheets

THREAD CUTTING DEVICE OF SEWING MACHINE

The present application claims priority from Japanese Patent Applications No. 2006-271867 and No. 2006-271885, both filed on Oct. 3, 2006, the entire contents of which are incorporated herein by reference.

TECHNICAL FIELD

The present invention relates to a thread cutting device of a sewing machine in which a thread is cut by a cooperation of a thread catching member and a fixed knife.

BACKGROUND ART

Conventionally, there is known a thread cutting device of a sewing machine which cuts a thread at an end of a sewing work (see, e.g., Japanese Patent No. 3106472).

As shown in FIG. 14A, a thread cutting device is arranged inside a bed portion of a sewing machine, and includes a thread catching member 610 which receives a power from a lower shaft interlocking with a sewing machine motor. The thread catching member 610 moves back and forth, and catches a thread T with a catching portion on a tip of the thread catching member 610 during a backward movement. Thereafter, the thread T is cut by the thread catching member 610 and a fixed knife.

Recently, there has been developed a thread cutting device of a sewing machine which employs a stepping motor for a driving source of a thread catching member, thereby driving the thread catching member at a low speed.

However, in the thread cutting device disclosed in the Japanese Patent No. 3106472, there is a limit in lowering a rotation speed of a servo motor employed as a sewing machine motor. More specifically, it is difficult to control the rotation speed of the servo motor in a low speed region. Therefore, it is difficult to sufficiently lower an operating speed of the thread catching member 610.

Accordingly, a bobbin 320 is rotated excessively when the lower thread T is vigorously pulled out from the bobbin 320 after being caught. As a result, as shown in FIG. 14B, there is a problem that the lower thread T is excessively pulled out from the bobbin 320. It can be proposed to suppress the rotation of the bobbin 320 by, for example, a biasing force of a spring. However, in a sewing machine which carries out a sewing work with various threads having different thickness and hardness, it is difficult to regulate such a biasing force appropriately. As a result, in a case in which the biasing force is too strong, there is a problem that the lower thread T might become entangled in the bobbin 320 so that it is difficult to pull out the lower thread T in a next sewing work.

In a case in which the thread catching member 610 is driven by a stepping motor, which is suitable for a low speed rotation and an angle control, a large and expensive stepping motor is required to ensure a sufficient torque for cutting a thick thread, for example. When an output torque of the stepping motor is insufficient for cutting a thick thread, there is a problem that a cutting failure is caused.

SUMMARY

An aspect of the present invention provides a thread cutting device of a sewing machine which can smoothly catch and cut a thread.

According to a first aspect of the invention, a thread cutting device of a sewing machine includes:

a thread catching member having a catching portion, wherein the thread catching member moves back and forth across a path of a lower thread reeled out from a bobbin so as to catch the lower thread by the catching portion, and cuts the lower thread by cooperating with a fixed knife;

a first power transmitting portion which transmits a power to the thread catching member;

a sewing machine motor operable to rotate a lower shaft;

a first cam member provided on the lower shaft, wherein the first cam member transmits a first moving force to the thread catching member through the first power transmitting portion;

a stepping motor operable to drive the thread catching member;

a second power transmitting portion which transmits a second moving force from the stepping motor to the thread catching member through the first power transmitting portion; and a cutting control unit operable to drive the stepping motor to move the thread catching member through the second power transmitting portion when catching the lower thread, and to drive the sewing machine motor to move the thread catching member through the first cam member when cutting the lower thread.

According to a second aspect of the invention, the second power transmitting portion includes a second cam member which is operated by the stepping motor, the first power transmitting portion has a follower adapted to abut against drivers of the first cam member and the second cam member, and the driver of the second cam member is operable to move the thread catching member backward and to move the follower to a position at which the driver of the first cam member is disengaged from the follower.

According to a third aspect of the invention, the first cam member includes an end face cam, wherein the driver of the first cam member is on an end face of the first cam member with respect to a thrust direction of the lower shaft, and the second cam member is a cylindrical cam inside which the first cam member is accommodated.

According to a fourth aspect of the invention, the first power transmitting portion includes an operating member having a follower adapted to engage with the first cam member, wherein the operating member moves back and forth to move the thread catching member back and forth, and the first cam member includes a rotating cam which is rotated by the lower shaft, wherein the rotating cam includes a permitting portion which allows the follower to move back and forth and an abutting portion which moves the follower backward in accordance with a rotating angle of the rotating cam.

According to a fifth aspect of the invention, the permitting portion has a straight groove portion formed on a circumferential surface of the first cam member along a thrust direction of the lower shaft, and the abutting portion has a spiral groove portion formed along the peripheral surface of the first cam member from a central part of the straight groove portion to one end of the first cam member in the thrust direction.

According to the first aspect of the invention, the stepping motor is driven by the cutting control unit so that the thread catching member is moved through the second power transmitting portion to catch the lower thread. Because the stepping motor is employed as a driving source for the thread catching member in the operation for catching the lower thread, it is possible to move the thread catching member at a low speed. Consequently, it is possible to prevent the lower thread from being excessively pulled out from the bobbin. After the lower thread is caught, the sewing machine motor is driven by the cutting control unit to move the thread catching member through the first cam member and so as to cut the lower thread. Because the sewing machine motor is employed as the driving source for the thread catching member in the operation for cutting the lower thread, it is possible to increase a cutting force as compared with a case in which the stepping motor is employed as the driving source. Accordingly, it is possible to execute a thread cutting operation without considering a type of the thread to be used (e.g., a thickness and hardness of threads). Consequently, it is possible to prevent a thread cutting failure.

More specifically, according to the first aspect of the invention, it is possible to smoothly catch and cut the lower thread while preventing both the excessive pull-out of the lower thread and the thread cutting failure.

According to the second aspect of the invention, the first power transmitting portion has the follower which can abut on the drivers of both the second cam member operated by the stepping motor and the first cam member operated by the sewing machine motor. By switching the driving source for driving the thread catching member to either the stepping motor or the sewing machine motor, it is possible to drive the thread catching member through either the first cam member or the second cam member.

Moreover, the follower of the first power transmitting portion can be moved back and forth by the driver of the second cam member to such a position as to be disengaged from the driver of the first cam member. Consequently, it is possible to implement a smooth sewing operation without interference of the first cam member rotated together with the lower shaft and the follower of the first power transmitting portion during the sewing work.

According to the third aspect of the invention, the second cam member accommodates the first cam member therein. Therefore, it is possible to smoothly catch and cut the thread with a simple structure while saving a space for the thread cutting device in the sewing machine.

According to the fourth aspect of the invention, when the follower of the moving member is engaged with the permitting portion of the rotating cam, which is the first cam member, the stepping motor is driven by the cutting control unit. Consequently, the thread catching member carries out the back and forth movement through the second power transmitting portion and the lower thread is thus caught. Because the stepping motor is employed as the driving source for the thread catching member in the operation for catching the lower thread, it is possible to move the thread catching means at a low speed. Consequently, it is possible to prevent the lower thread from being excessively pulled out from the bobbin. When the follower of the operating member is engaged with the abutting portion of the rotating cam after the lower thread is caught, the cutting control unit drives the sewing machine motor. Thus, the thread catching member carries out the backward movement through the rotating cam so that the lower thread is cut. Because the sewing machine motor is employed as the driving source for the thread catching unit in the operation for cutting the lower thread, it is possible to increase the cutting force as compared with a case in which the stepping motor is employed as the driving source to cut the thread. Accordingly, it is possible to execute the thread cutting operation without considering a type of the thread to be used (e.g., a thickness and hardness of threads). Thus, it is possible to prevent the thread cutting failure. Namely, it is possible to smoothly catch and cut the lower thread while preventing both the excessive pull-out of the lower thread and the thread cutting failure.

According to the fifth aspect of the invention, the cutting control unit drives the stepping motor when the follower of the moving member is engaged with the straight groove portion (the permitting portion). Consequently, the thread catching member carries out the back and forth movement through the second power transmitting means so that the lower thread is caught. The cutting control unit drives the sewing machine motor when the follower of the moving member is engaged with the spiral groove portion (the abutting portion). Consequently, the thread catching member carries out the backward movement through the rotating cam so that the lower thread is cut.

DETAILED DESCRIPTION

Figure 1:
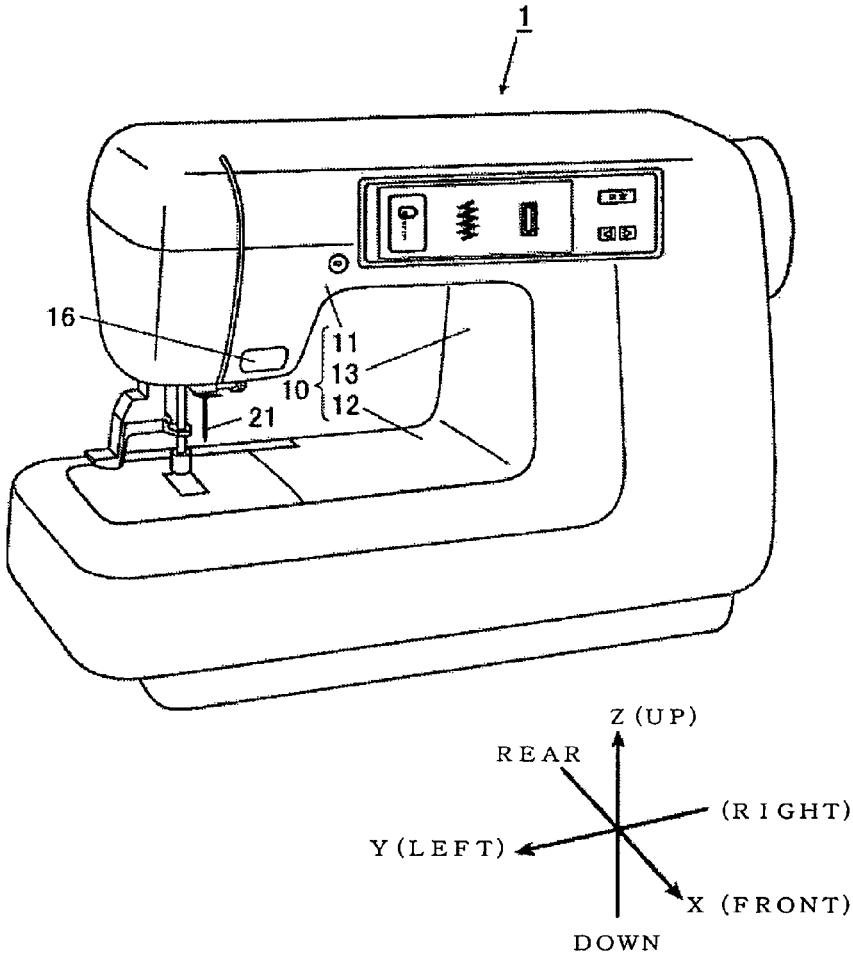
FIG. 1 is a schematic perspective view showing an exterior of a sewing machine according to an exemplary embodiment of the invention.

Hereinafter, exemplary embodiments of the invention will be described in detail with reference to the drawings. The following exemplary embodiments and the drawings do not limit the scope of the invention. In the exemplary embodiments, respective directions in each portion of a sewing machine 1 are defined on the basis of X, Y and Z axes shown in the drawings. In a state in which the sewing machine 1 is placed on a horizontal plane, a Z-axis direction is a vertical direction which is also described as an up and down direction, a Y-axis direction is a right and left direction extending along a longitudinal direction of an arm portion 11, and an X-axis direction is a front and rear direction which is horizontal and is orthogonal to the Y-axis direction.

(Whole Structure of Sewing Machine)

FIG. 1 is a schematic perspective view of a sewing machine having a thread cutting device (a thread cutting mechanism) according to an exemplary embodiment of the invention.

The sewing machine 1 may be a sewing machine for domestic use which feeds a cloth along a predetermined cloth feeding direction with an optional feeding pitch while swinging a needle in a direction orthogonal to the cloth feeding direction, whereby the needle is moved down to an optional position on a workpiece for each stitch so that an required pattern is sewn.

FIRST EXEMPLARY EMBODIMENT

Figure 3:
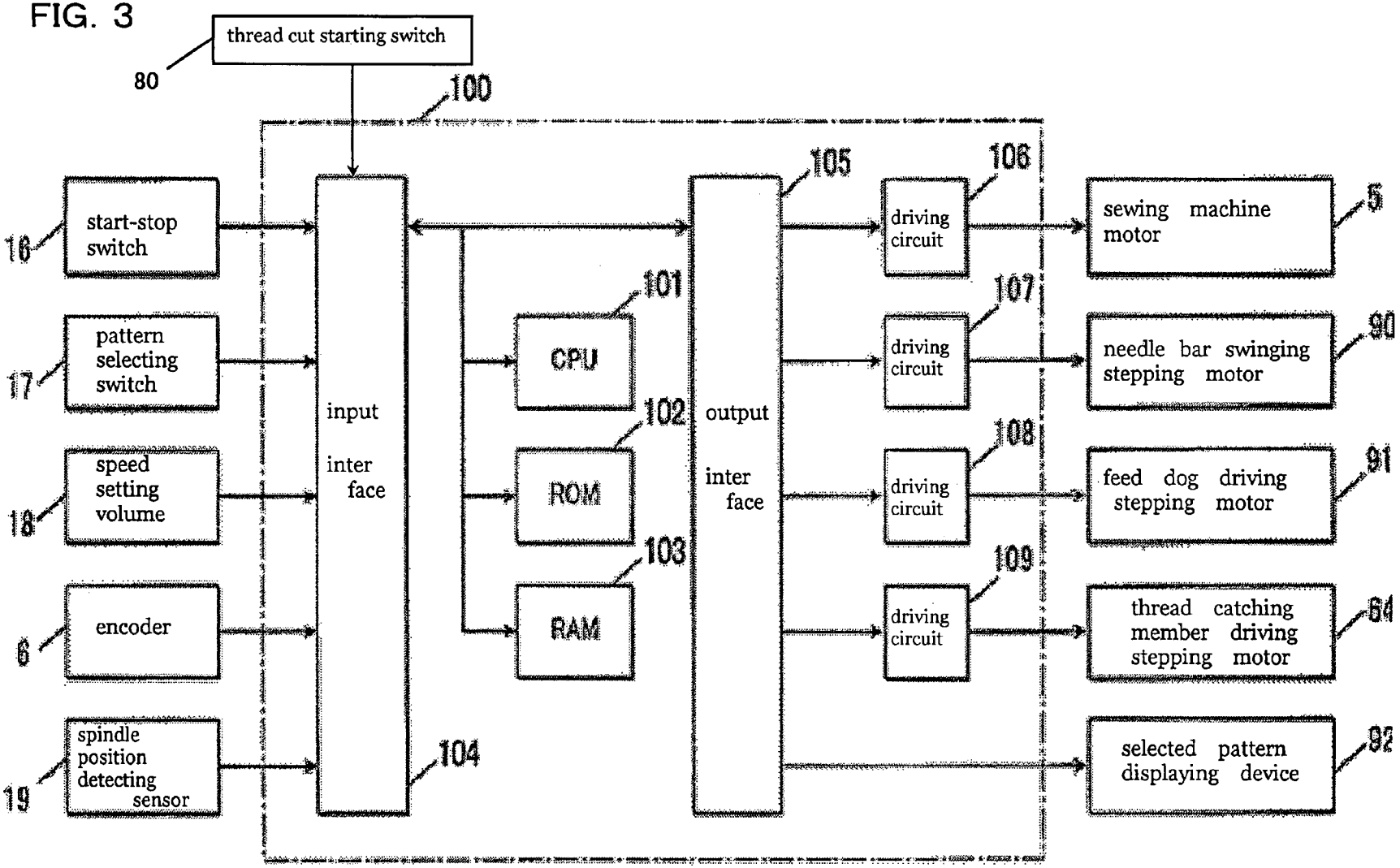
FIG. 3 is a control block diagram showing an electrical configuration of a sewing machine according to en exemplary embodiment of the invention.

As shown in FIGS. 1 and 3, a sewing machine 1 includes a sewing machine frame 10 inside which a thread cutting mechanism 60 (a thread cutting device) is accommodated, a needle driving mechanism which is disposed inside the sewing machine frame 10 and drives a needle 21 in the vertical direction, a shuttle mechanism 30 which forms a seam by cooperating with the needle driving mechanism, a sewing machine motor 5 which serves as a driving source for the vertical motion of the needle 21, an encoder 6 which detects a rotation amount of the sewing machine motor 5, the thread cutting mechanism 60 which cuts a thread T, a thread cutting button 80 (a thread cut starting switch) for actuating the thread cutting mechanism 60, a spindle position detecting sensor 19 which detects a certain position (for example, an upper position) of a spindle within a rotation of the spindle, and a control portion 100 which controls an operation of the sewing machine motor 5.

Each of the components will be described below in detail. The sewing machine 1 further includes a needle bar swinging stepping motor (not shown) which serves as a driving source for swinging the needle, a feed dog driving stepping motor (not shown) which serves as a driving source for feeding a cloth feed, a selected pattern displaying device 92 (may be a liquid crystal panel) which displays a selected pattern to be sewn, a start-stop switch 16 from which a start and a stop of a sewing operation of the sewing machine is input, a pattern selecting switch 17 from which a pattern to be sewn is selected, and a speed setting volume 18 (speed setting means) from which a speed of a needle movement is input. However, because configurations thereof are similar to those of the conventional ones, detailed description thereof will be omitted in the description of exemplary embodiments.

(Sewing Machine Frame)

As shown in FIG. 1, the sewing machine frame 10 includes an arm portion 11 forming an upper part of the sewing machine frame 10, a bed portion 12 forming a lower part of the sewing machine frame 10 and extending parallel to the arm portion 11, and a vertical drum portion 13 coupling the arm portion 11 and the bed portion 12 and extending in the vertical direction (Z-axis direction) which is orthogonal to a longitudinal direction of the arm portion 11 and the bed portion 12. An outer shape of the sewing machine frame 10 is an almost C shape when seen from a front.

An upper shaft (not shown), i.e. a spindle, is rotatably provided in the arm portion 11, and the sewing machine motor 5 (see FIG. 3) is coupled to the upper shaft. A lower shaft 2 is rotatably provided in the bed portion 12 and is coupled to the upper shaft through a pulley and a belt (not shown). When the upper shaft is rotated by the sewing machine motor 5, the lower shaft 2 is rotated in synchronization with the upper shaft. The lower shaft 2 is rotated at a rotating speed with a one-to-one correspondence to the upper shaft. In other words, rotating angles of the upper shaft and that of the lower shaft correspond to each other.

(Needle Driving Mechanism)

The needle driving mechanism (not shown) includes a rotating weight (not shown) fixed to a tip portion of the upper shaft inside a tip portion of the arm portion 11, a crank rod (not shown) which is rotatably coupled to an eccentric portion of the rotating weight, a needle bar coupled to a lower end of the crank rod, and the needle 21 supported on a lower end of the needle bar. When the upper shaft is rotated by the driving operation of the sewing machine motor 5, a vertical motion is transmitted to the needle bar through the rotating weight and the crank rod so that the needle 21 carries out a reciprocating vertical motion.

(Shuttle Mechanism)

The shuttle mechanism 30 is disposed inside a tip portion of the bed portion 12 and includes a horizontal shuttle 31 which is rotated around a shuttle shaft (not shown) arranged vertically along the Z-axis direction.

The horizontal shuttle 31 has an outer shuttle 31*a* which is rotated by the lower shaft 2 through a shuttle shaft gear (not shown), and an inner shuttle 31*b* which is provided on an inner side of the outer shuttle 31*a* and is not rotated. The outer shuttle 31*a* is rotated at a double speed (in terms of a rotating speed) of the lower shaft 2 and the upper shaft, and a hook provided on an outer periphery thereof catches a loop of an upper thread formed inside the bed portion 12 when the needle 21 is lifted. A bobbin 32 around which the lower thread T is wound is provided exchangeably and rotatably in the inner shuttle 31*b*.

An upper part of the horizontal shuttle 31 is opened, and the lower thread T reeled out from the bobbin 32 is supplied along a lower thread path of the lower thread T and is entangled with the upper thread so that a seam is formed.

(Thread Cutting Mechanism)

The thread cutting mechanism 60 (the thread cutting device) of the sewing machine according to the first exemplary embodiment will be described in detail with reference to FIG. 2.

Figure 2:
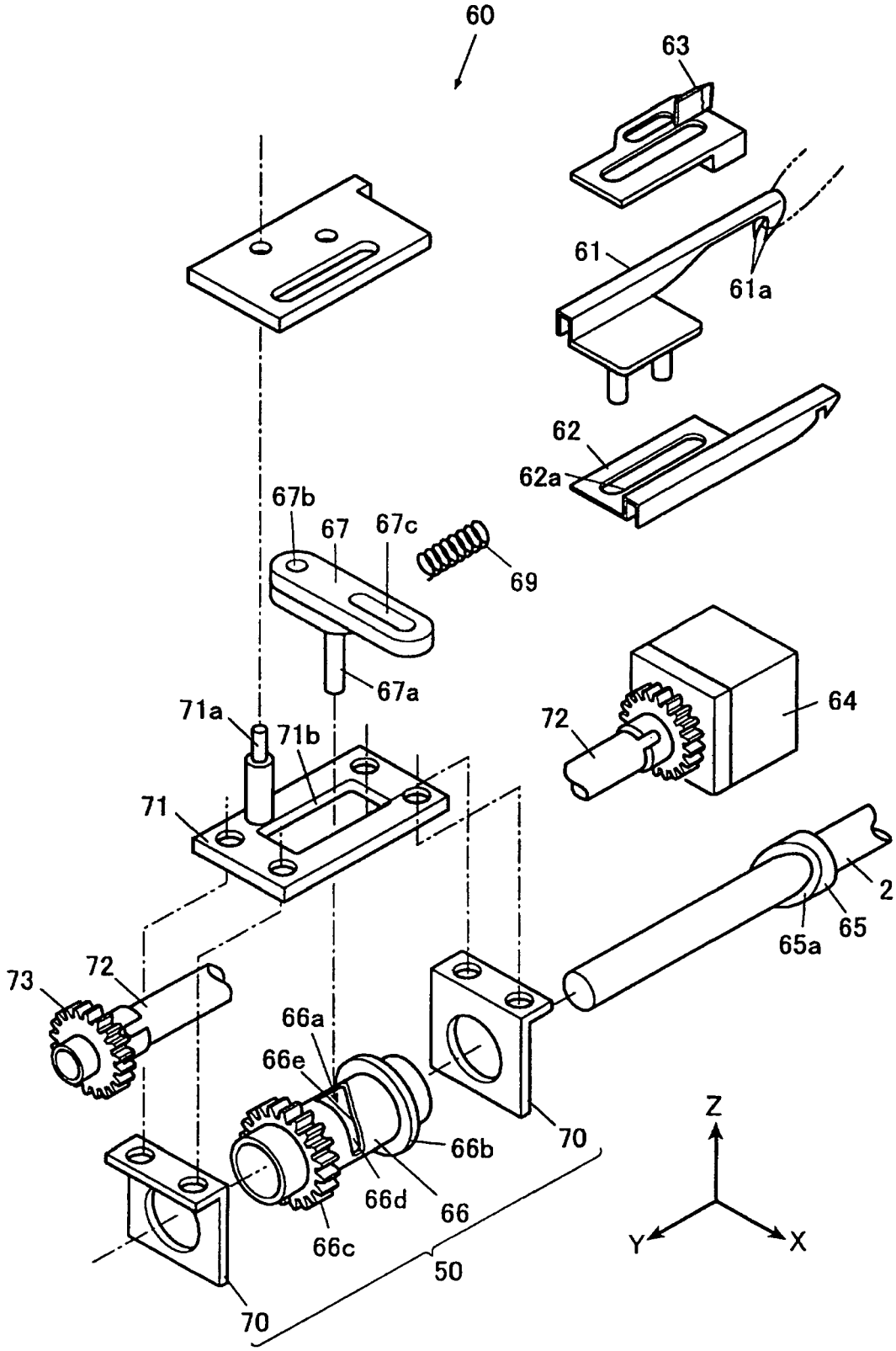
FIG. 2 is an exploded perspective view showing a structure of a thread cutting device according to a first exemplary embodiment of the invention.

As shown in FIG. 2, the thread cutting mechanism 60 includes a thread catching member 61 (a thread catching portion) which has a forked catching portion 61*a*. The thread catching member 61 moves back and forth across the lower thread path for the lower thread T reeled out from the bobbin 32 (see FIG. 7B), thereby guiding the lower thread T caught by the catching portion 61*a* toward a fixed knife 63 to cut the lower thread T. The thread cutting mechanism further includes a catching portion operating link 67 (first power transmitting portion, first power transmitting means) which transmits a power to the thread catching member 61, a spring 69 (biasing means) which applies force to the thread catching member 61 in a forward direction of the back and forth movement, a thread cutting cam 65 (a first cam member) which is provided on the lower shaft 2 rotated by the sewing machine motor 5 and transmits a moving force to the thread catching member 61 through the catching portion operating link 67, a thread catching member driving stepping motor 64 (a stepping motor) which drives the thread catching member 61, and a second power transmitting portion (second power transmitting means) 50 which transmits a moving force from the thread catching member driving stepping motor 64 to the thread catching member 61 through the catching portion operating link 67.

The thread catching member 61 includes the catching portion 61*a* having a tip curved toward a rear side of the back and forth movement. The thread catching member 61 moves back and forth in the Y-axis direction along a slot 62*a* of a catching base 62 which catches the upper thread. The thread catching member can also move back and forth in the Y-axis direction with respect to the fixed knife 63 and together with the catching base 62.

The catching portion operating link 67 is coupled rotatably with respect to the thread catching member 61 through a slot portion 67*c* which is provided on one end portion in a longitudinal direction thereof. The catching portion operating link 67 has an engaging portion 67*a* on a lower side at a central part in the longitudinal direction thereof, and the engaging portion 67*a* is engageable with an end face cam portion 65*a*. The engaging portion 67*a* is a follower which can abut on drivers of both a catching portion driving cam 66 (a second cam member) and the thread cutting cam 65 so that it is formed to have such a length as to abut on both of the drivers.

The catching portion operating link 67 is rotatably held by a projection 71*a* protruded from a holding member 71 at the other end portion 67*b* in a longitudinal direction thereof, and is turnable in a horizontal direction around the projection 71*a*. The holding member 71 has a through hole 71*b* which vertically penetrates through a central part thereof, and allows the engaging portion 67*a* to be engaged with the thread cutting cam 65 and the catching portion driving cam 66 through the through hole 71*b*. The holding member 71 also allows the catching portion operating link 67 to turn in the horizontal direction with the projection 71*a* being a fulcrum.

The spring 69 is coupled to the catching portion operating link 67. The spring 69 constantly biases the thread catching member 61 in a direction in which the thread catching member 61 moves in a forward direction. Namely, the engaging portion 67*a* of the catching portion operating link 67 is constantly biased in such a direction as to abut on the end face cam portions 65*a*, 66*a*.

The thread cutting cam 65 is fixed to the lower shaft 2, and an end face in a thrust direction of the lower shaft 2, (more specifically, an end face on a rear side in the direction of the back and forth movement of the thread catching member 61) serves as the end face cam portion 65*a* (an end face cam). The end face cam portion 65*a* acts as a driver of the thread cutting cam 65 and engages with the engaging portion 67*a* of the catching portion operating link 67 serving as the follower.

The second power transmitting portion 50 includes the catching portion driving cam 66 having a cylindrical shape and support members 70 which rotatably supports both ends of the catching portion driving cam 66.

The support members 70 is fixed inside the bed portion 12 and rotatably supports the catching portion driving cam 66. The holding member 71 is coupled to an upper part of the support members 70.

The catching portion driving cam 66 is arranged such that its thrust direction extends along the Y-axis direction, and is a cylindrical cam inside which the thread cutting cam 65 is accommodated. The catching portion driving cam 66 functions as a second cam member according to the first exemplary embodiment. More specifically, the thread cutting cam 65 is rotatably inserted into the catching portion driving cam 66 together with the lower shaft 2 to which the thread cutting cam 65 is fixed.

Flange portions 66*b*, 66*c* are provided on the respective end portions of the catching portion driving cam 66 around an outer circumferential portion thereof. Each of the flange portions 66*b*, 66*c* abuts against the respective support members 70, whereby the catching portion driving cam 66 is positioned along the thrust direction. An outer circumference of one of the flanges 66*c* is toothed, i.e., is formed as a gear 66*c*. The fear 66*c* transmits a power (a rotating force) from the thread catching member driving stepping motor 64 (a driving source) to the catching portion driving cam 66.

The catching portion driving cam 66 is formed with an opening portion 66*a* penetrating through the catching portion driving cam 66 from an inner surface to an outer surface. The opening portion 66*a* includes a standby portion 66*d* and a cam portion 66*e*. The standby portion 66*d* is formed on a side of the gear 66*c* along a circumferential direction of the catching portion driving cam 66, that is, orthogonally to the thrust direction. The cam portion 66*e* is formed obliquely with respect to the Y-axis direction. More specifically, the cam portion 66*e* is formed such that a side edge of the cam portion 66*e* on a side of the flange portion 66*b* is extended toward the flange 66*b* from a side edge of the standby portion 66*d* on a side of the flange portion 66*b* at an obtuse angle with respect to the side edge of the standby portion 66*d* so that an opening area expands.

Figure 7A:
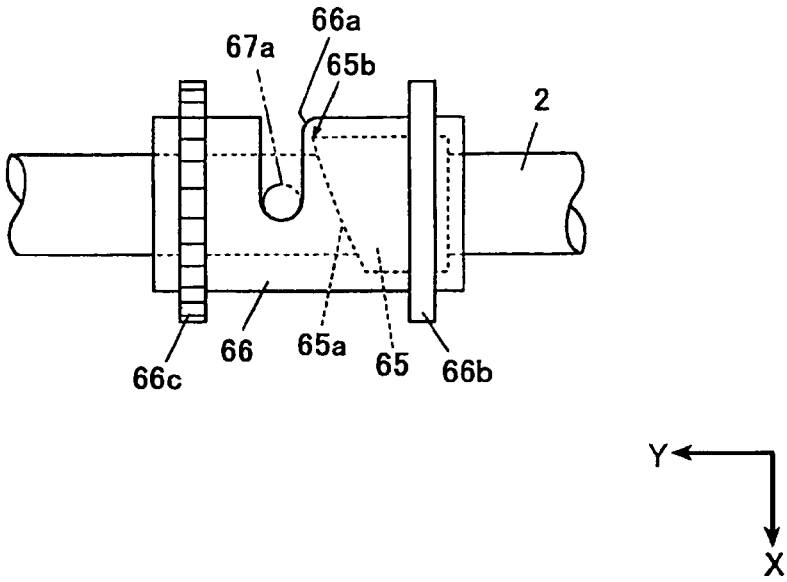
FIGS. 7A and 7B are views illustrating positions of a catching portion driving cam and a thread catching member during a sewing operation.
Figure 7B:
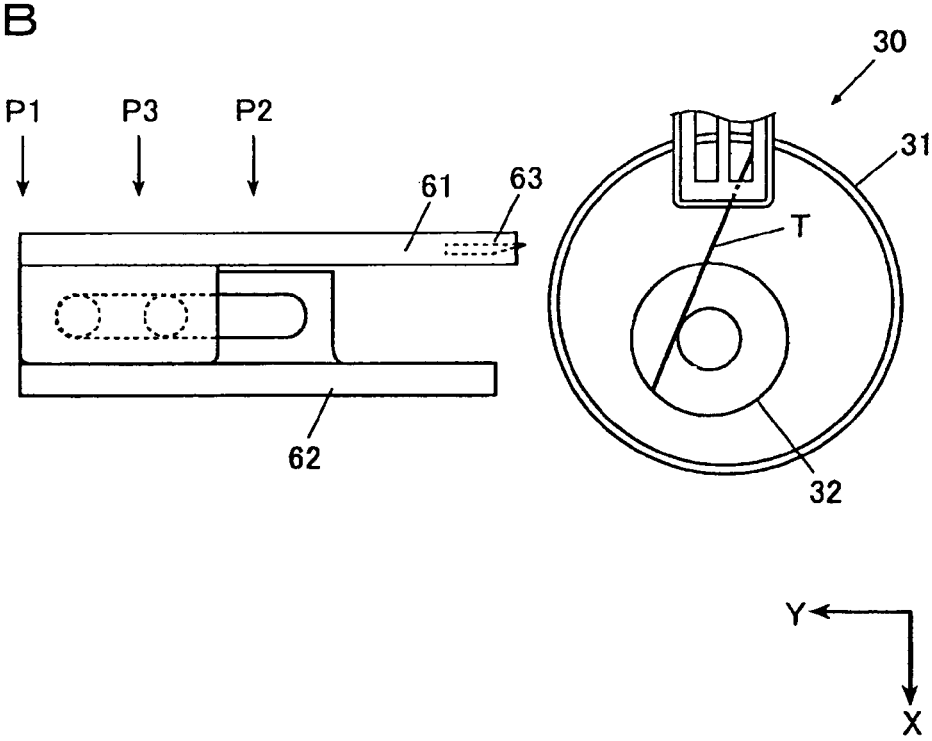

When the engaging portion 67*a* is engaged with the standby portion 66*d*, the thread catching member 61 in positioned at a rearmost position in its back and forth movement, i.e., a standby position P1 (see FIG. 7B).

When the catching portion driving cam 66 is rotated around its axis, the engaging portion 67*a* abuts against the cam portion 66*e* and is moved in the Y-axis direction by a biasing force of the spring 69. Namely, when the engaging portion 67*a* is guided along the cam portion 66*e*, the cam portion 66*e* horizontally turns the catching portion operating link 67 around the projection 71*a* of the holding member 71, thereby moving the thread catching member 61 from the rearmost position (the standby position P1) to a foremost position P2 (see FIG. 9B). When the thread catching member 61 is positioned at the foremost position P2, the engaging portion 67*a* is disposed at an end portion of the cam portion 66*b* which is closest to the flange 66*b*, and a rotation of the catching portion driving cam 66 is regulated at the end portion.

When the cam portion 66*e* of the catching portion driving cam 66, which is the driver according to the first exemplary embodiment, moves the thread catching member 61 backward through the catching portion operating link 67, the engaging portion 67*a* can be moved to a position at which the end face cam portion 65*a* of the thread cutting cam 65 (the other driver) is disengaged from the engaging portion 67*a* (the follower). Accordingly, when the engaging portion 67*a* is disposed in the standby portion 66*d* so that the thread catching member 61 is positioned at the standby position P1, the engaging portion 67*a* is disengaged from the thread cutting cam 65 without an abutment so that the lower shaft 2 and the thread cutting cam 65 can be freely rotated without being disturbed.

Figure 4:
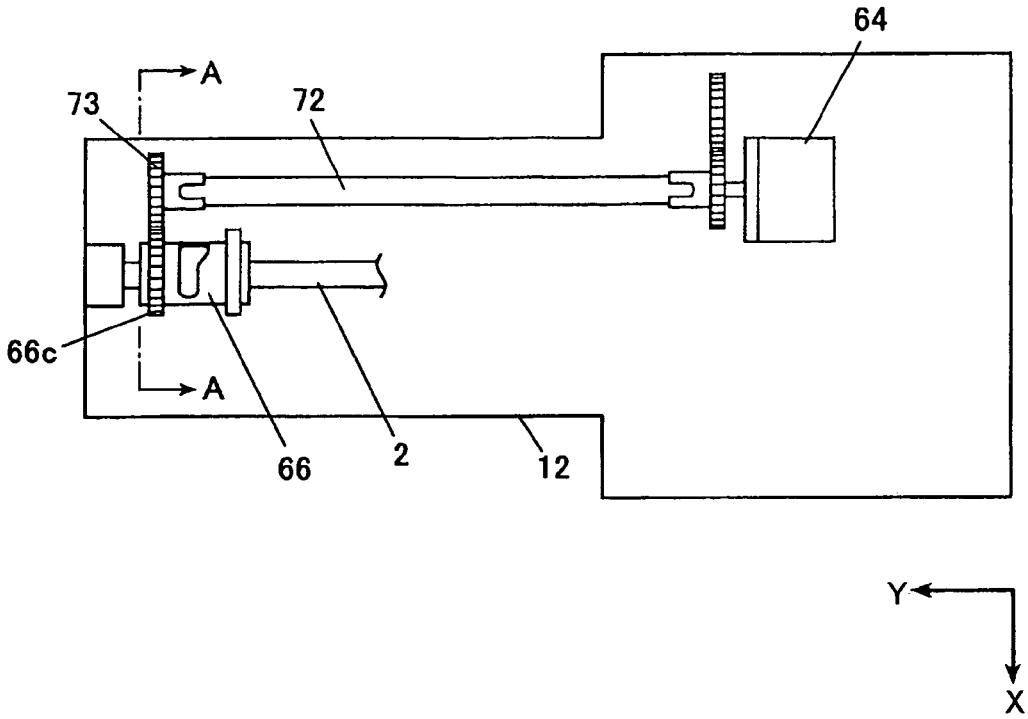
FIG. 4 is a plan view showing an arrangement of the thread cutting device according to the first exemplary embodiment of the invention.
Figure 5:
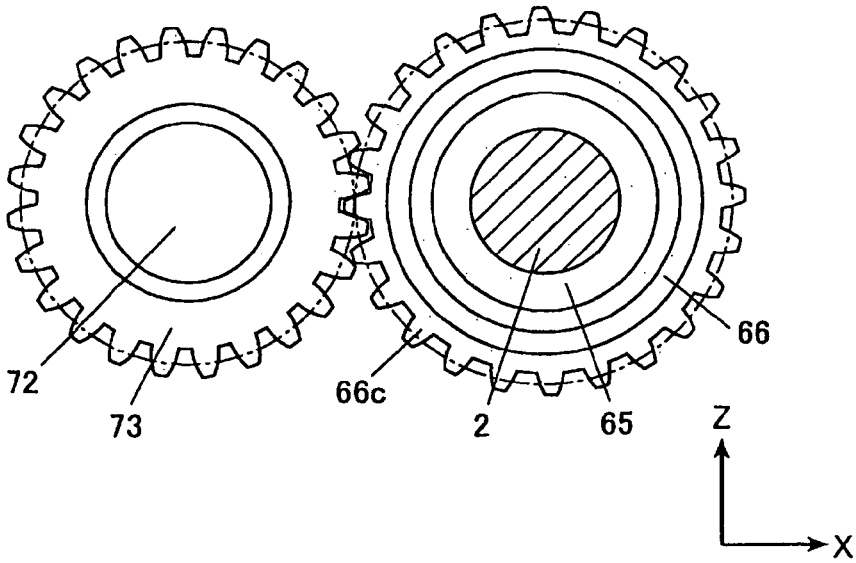
FIG. 5 is a sectional view taken along the line V-V shown in FIG. 4.
Figure 6:
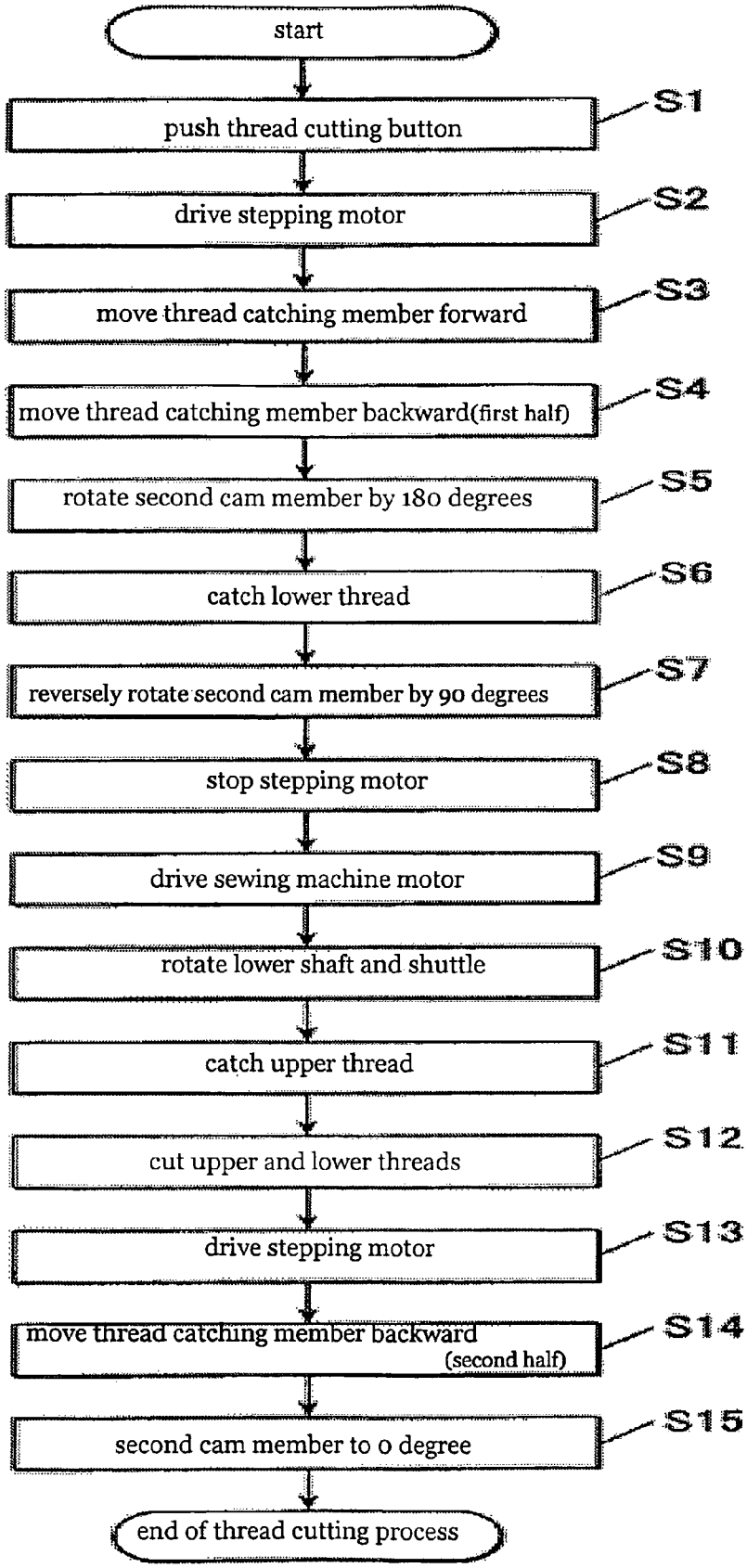
FIG. 6 is a flowchart showing an operation of the thread cutting device according to the first exemplary embodiment of the invention.

As shown in FIG. 4, the thread catching member driving stepping motor 64 is disposed on a rear side inside the bed portion 12. The thread catching member driving stepping motor 64 has an output shaft extending in the Y-axis direction toward a tip side of the bed portion 12. One end of a torque transmitting shaft 72, extending parallel to the lower shaft 2, is coupled to the output shaft of the thread catching member driving stepping motor 64, and a gear 73 which meshes with the gear portion 66*c* is provided on the other end of the torque transmitting shaft 72.

Thus, when the thread catching member driving stepping motor 64 is driven, the catching portion driving cam 66 is rotated through the torque transmitting shaft 72, the gear 73 and the gear 66*c*, and the engaging portion 67*a* (the follower) is driven along the cam portion 66*e* (the driver) of the catching portion driving cam 66. As a result, the thread catching member 61 can be moved back and forth through the catching portion operating link 67. As for an amount of the driving operation of the thread catching member driving stepping motor 64 corresponding to an amount of the back and forth movement of the thread catching member 61, the number of pulses corresponding to various amounts of the back and forth movement is experimentally obtained in advance and is stored in an ROM 102 which is a storing portion of the control portion 100.

(Control System of Sewing Machine)

Next, a control system of the sewing machine 1 will be described in detail with reference to FIG. 3.

FIG. 3 is a block diagram showing an electrical configuration of the sewing machine 1 according to an exemplary embodiment. As shown in FIG. 3, the control portion 100 includes the ROM 102 in which various programs for carrying out various controls and processings, sewing data for carrying out various pattern sewing operations, and other various setting data are stored, a CPU 101 which executes the various programs in the ROM 102, an RAM 103 serving as a work area in an execution of the various programs, an input interface 104 and an output interface 105 which are connected to the CPU 101, the ROM 102 and the RAM 103 through a bus, a switching driving circuit 106 which drives the sewing machine motor 5 by supplying a power thereto, a driving circuit 107 which drives a needle bar swinging stepping motor 90 by supplying a power thereto, another driving circuit 108 which drives a feed dog driving stepping motor 91 by supplying a power thereto, and another driving circuit 109 which drives the thread catching member driving stepping motor 64 by supplying a power thereto.

The input interface 104 transmits, to the CPU 101, signals input from the start-stop switch 16, the pattern selecting switch 17, the speed setting volume 18, the encoder 6 and the spindle position detecting sensor 19. The output interface 105 carries out a predetermined control for the driving circuits 106, 107 and 108 and the selected pattern displaying device 92 in accordance with a command from the CPU 101.

The encoder 6 includes a disk attached to the rotating shaft of the sewing machine motor 5 and an optical sensor, which are not shown. A slit is formed at a regular interval on the disk along a circumferential direction. The optical sensor includes a light source and a light receiving unit, and the disk is interposed therebetween. When an upper shaft (not shown) rotates, a light emitted from the light source repeats transmission and interception with respect to the disk, whereby a pulse signal is generated in the light receiving unit. The encoder 6 may be designed such that the optical sensor generates 180 pulses in one rotation of the upper shaft. A pulse signal output from the encoder 6 is input to a pulse counter of the input interface 104.

The control portion 100 (a cutting control unit or cutting control means according to the first exemplary embodiment) drives the thread catching member driving stepping motor 64 to move the thread catching member 61 through the catching portion driving cam 66 of the second power transmitting portion so as to catch the lower thread T, and then drives the sewing machine motor 5 to move the thread catching member 61 through the thread cutting cam 65 so as to cut the lower thread T.

Namely, the control portion 100 executes, as the cutting control means, a processing of driving the thread catching member driving stepping motor 64, thereby moving the thread catching member 61 through the catching portion driving cam 66 and the catching portion operating link 67 to catch the lower thread T, and then driving the sewing machine motor 5, thereby moving the thread catching member 61 through the thread cutting cam 65 and the catching portion operating link 67 to cut the lower thread T. According to the first exemplary embodiment, when the pressing operation to the thread cutting button 80 (the thread cut starting switch) is detected, the CPU 101 reads a detection signal from the spindle position detecting sensor 19, and the operation processing is carried out by the control portion 100 when the lower shaft 2 is positioned at a predetermined rotating angle (for example, an angle of the lower shaft at which the needle bar is stopped at its lower position).

(Operation According to First Exemplary Embodiment)

Next, an operation of the sewing machine 1 having the above configuration will be described with reference to a flowchart of FIG. 6 and FIGS. 7A to 13.

As shown in FIG. 7A, the engaging portion 67*a* of the catching portion operating link 67 is disposed in the standby portion 66*d* of the catching portion driving cam 66 during a sewing work. Therefore, the engaging portion 67*a* and the thread cutting cam 65 do not interfere with each other so that the lower shaft 2 and the thread cutting cam 65 can be freely rotated. As shown in FIG. 7B, the thread catching member 61 stands by in a state in which it is positioned at the rearmost position, that is, the standby position P1.

Figure 8A:
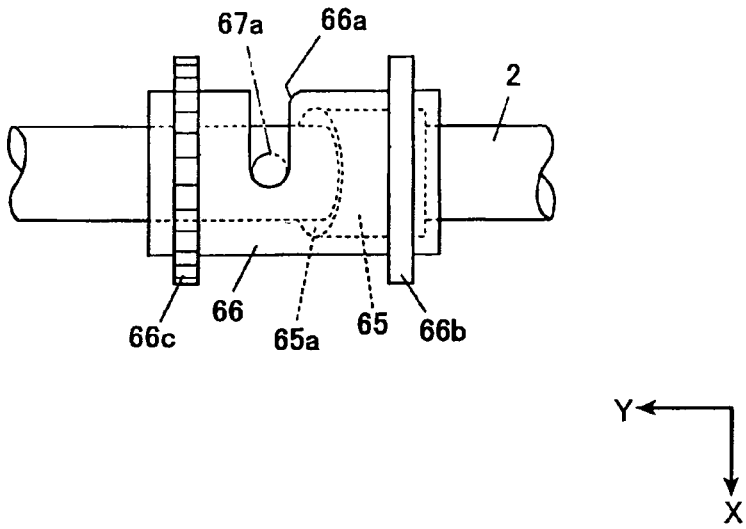
FIGS. 8A and 8B are views illustrating the positions of the catching portion driving cam and the thread catching member at an end of the sewing operation.
Figure 8B:
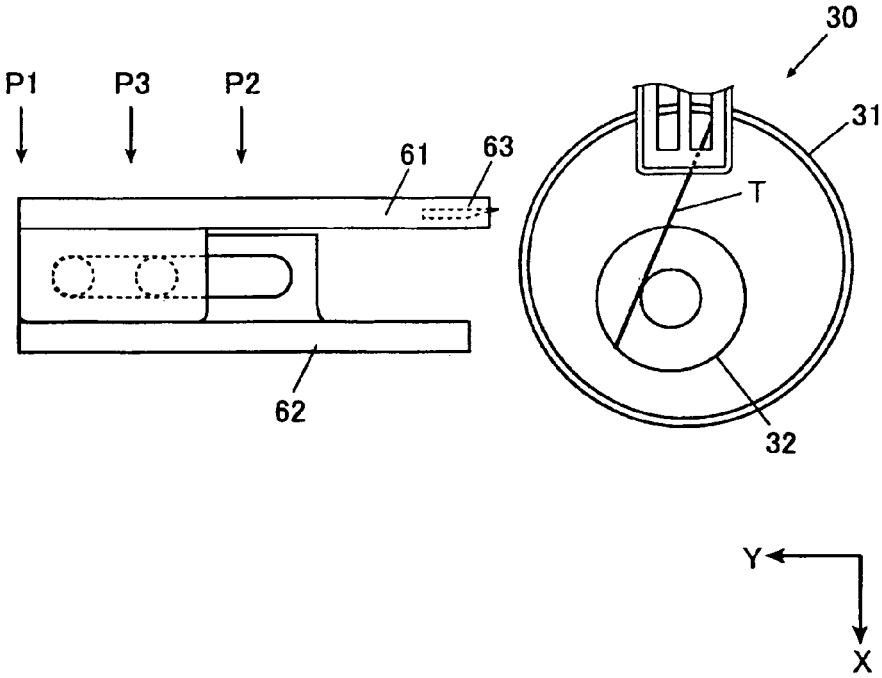

When the sewing work is ended, the sewing machine motor 5 is stopped so that the upper shaft and the lower shaft 2 are stopped in a state in which the needle 21 is stopped at its lower position. At this time, the thread cutting cam 65 is stopped in a state in which a tip 65*b* of the end face cam portion 65*a* is disposed on a lower side of the lower shaft 2, i.e., on a side opposite to the engaging portion 67*a* of the catching portion operating link 67 with respect to an axis of the lower shaft 2, as shown in FIG. 8A. Accordingly, a space is ensured for a tip of the engaging portion 67*a* to move to a position at which the thread catching member 61 is moved to the foremost position P2 when the catching portion driving cam 66 is driven. As shown in FIG. 8B, the thread catching member 61 is still positioned at the standby position P1 at this stage.

Figure 9A:
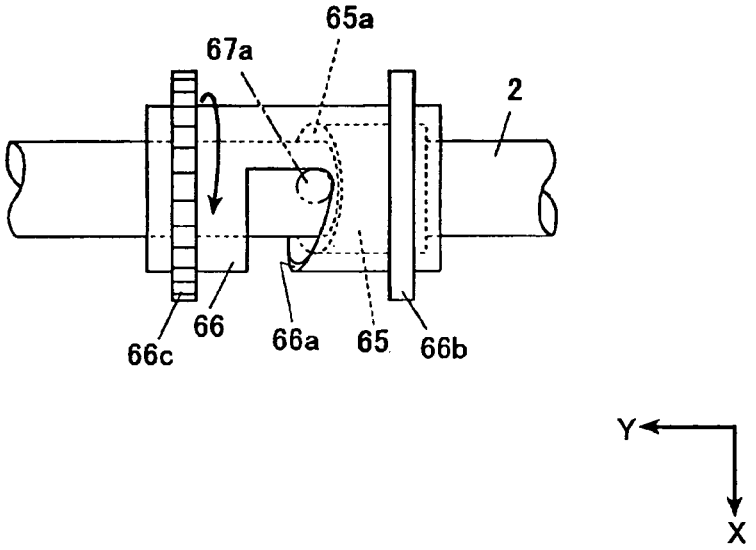
FIGS. 9A and 9B are views illustrating the positions of the catching portion driving cam and the thread catching member in which the catching portion driving cam is rotated by 180 degrees from its initial position.
Figure 9B:
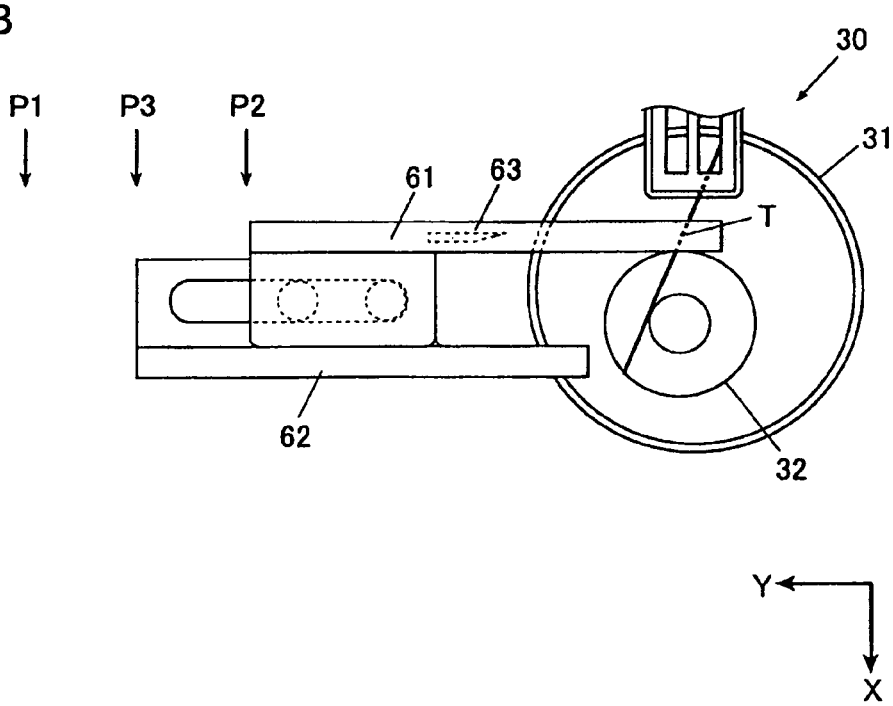

When the thread cutting button 80 is pressed (Step S1), the CPU 101 executes a processing of driving the thread catching member driving stepping motor 64 through the driving circuit 109 (Step S2) to rotate the catching portion driving cam 66 in a circumferential direction. Consequently, the engaging portion 67*a* abutting on the end face cam portion 66*a* of the catching portion driving cam 66 is moved in a rightward direction along the end face cam portion 66*a* of the catching portion driving cam 66 by the biasing force of the spring 69, and the catching portion operating link 67 is rotated in such a direction as to move the thread catching member 61 forward around the fulcrum 67*b*, whereby the thread catching member 61 is moved in the forward direction (Step S3). When the thread catching member driving stepping motor 64 is further driven until the catching portion driving cam 66 is rotated by 180 degrees from an initial position (Step S4) as shown in FIG. 9A, the thread catching member 61 is moved to the foremost position P2 across the lower thread path as shown in FIG. 9B. At this time, the thread catching member 61 is relatively moved toward a forward side of the back and forth movement with respect to the catching base 62 along the slot 62*a* of the catching base 62.

Figure 10A:
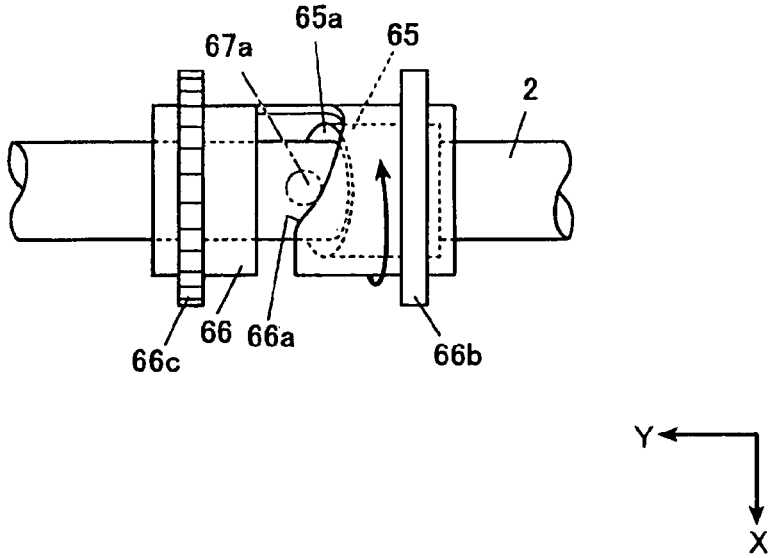
FIGS. 10A and 10B are views illustrating the positions of the catching portion driving cam and the thread catching member in which the catching portion driving cam is reversely rotated by 90 degrees from its initial position to positions.
Figure 10B:
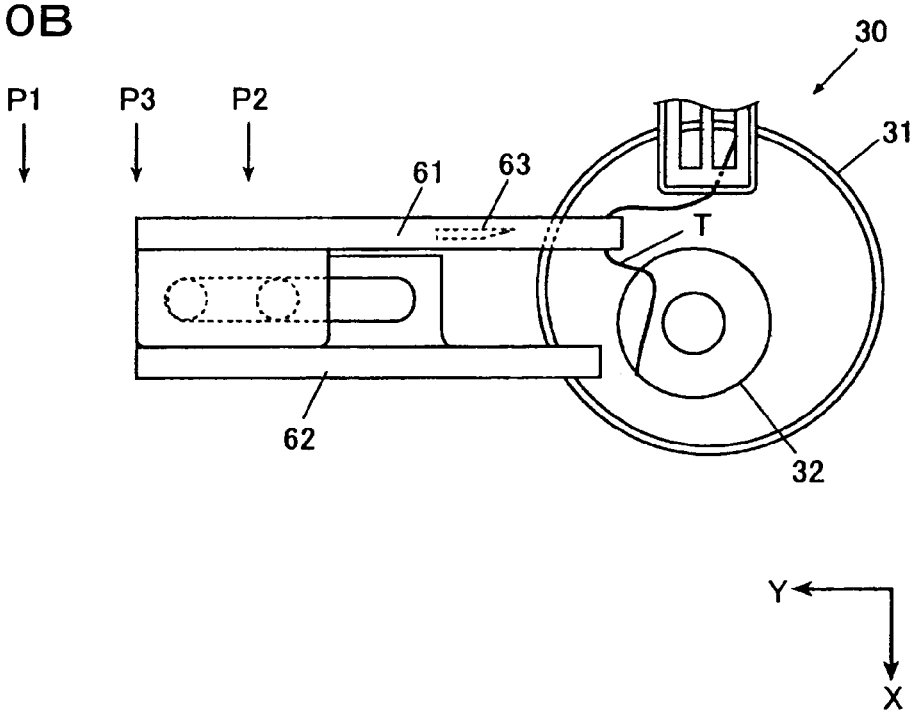

When the thread catching member 61 reaches the foremost position P2, the CPU 101 executes a processing of rotating the thread catching member driving stepping motor 64 through the driving circuit 109 at a low speed in a reverse direction, thereby rotating the catching portion driving cam 66 in a reverse direction and moving the thread catching member 61 backward at a low speed (Step S5). Consequently, the thread catching member 61 carries out a backward movement so that the lower thread T is caught by the catching portion 61*a* (Step S6), and the lower thread T is slowly pulled out from the bobbin 32. When the catching portion driving cam 66 is reversely rotated to a position of 90 degrees from the initial position as shown in FIG. 10A (Step S7) so that the thread catching member 61 is at a thread catching position P3 as shown in FIG. 10B, the CPU 101 executes a processing of stopping the thread catching member driving stepping motor 64 through the driving circuit 109 (Step S8) and driving the sewing machine motor 5 through the driving circuit 106 (Step S9).

Figure 11A:
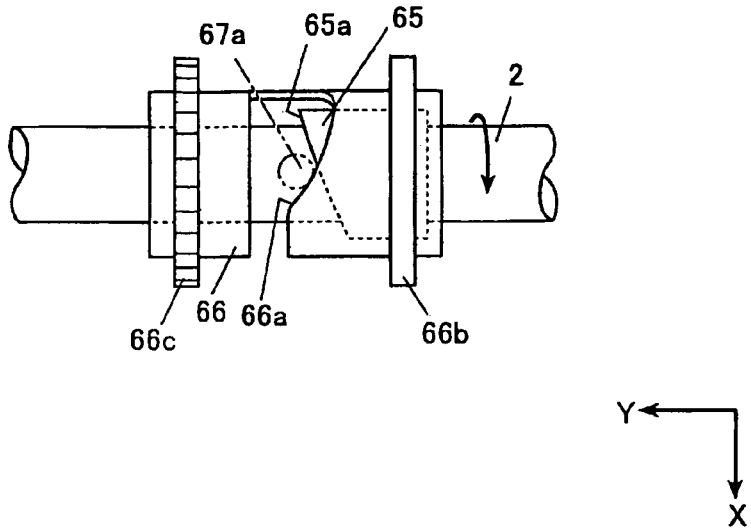
FIGS. 11A and 11B are views illustrating a state in which an upper thread is caught by the thread catching member.
Figure 12A:
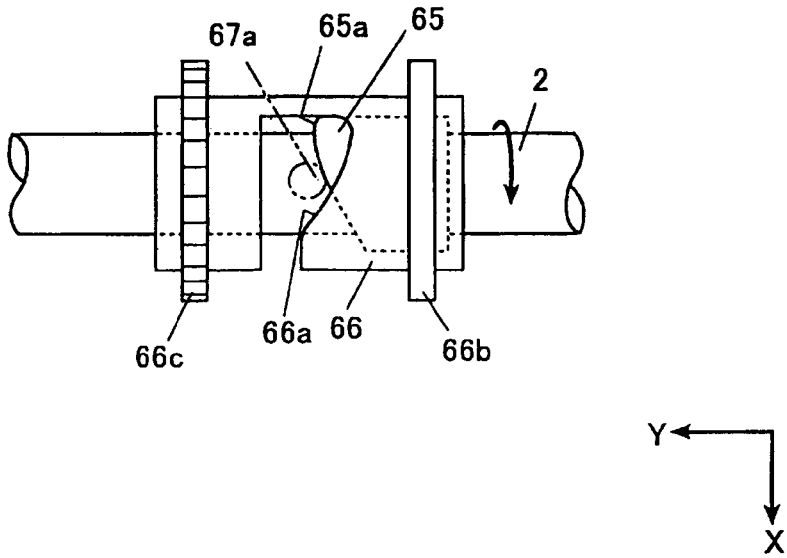
FIGS. 12A and 12B are views illustrating a state in which the upper and lower threads are cut.

When the sewing machine motor 5 is driven, the lower shaft 2 and the thread cutting cam 65 are rotated as shown in FIGS. 11A and 12A so that the horizontal shuttle 30 (more specifically, the outer shuttle 31*a*) coupled to the lower shaft 2 is rotated (Step S10).

Figure 11B:
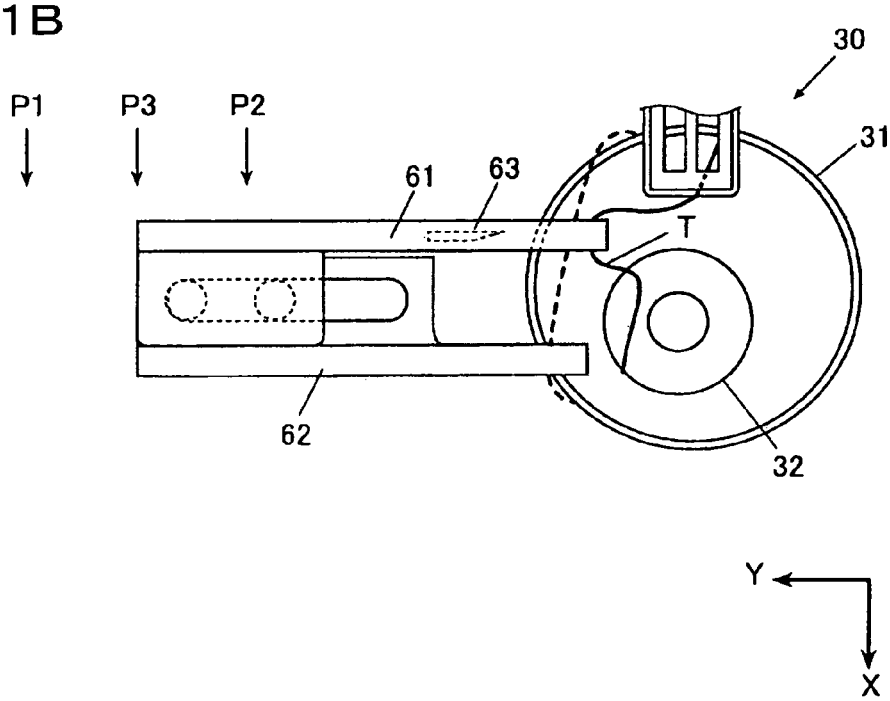
Figure 12B:
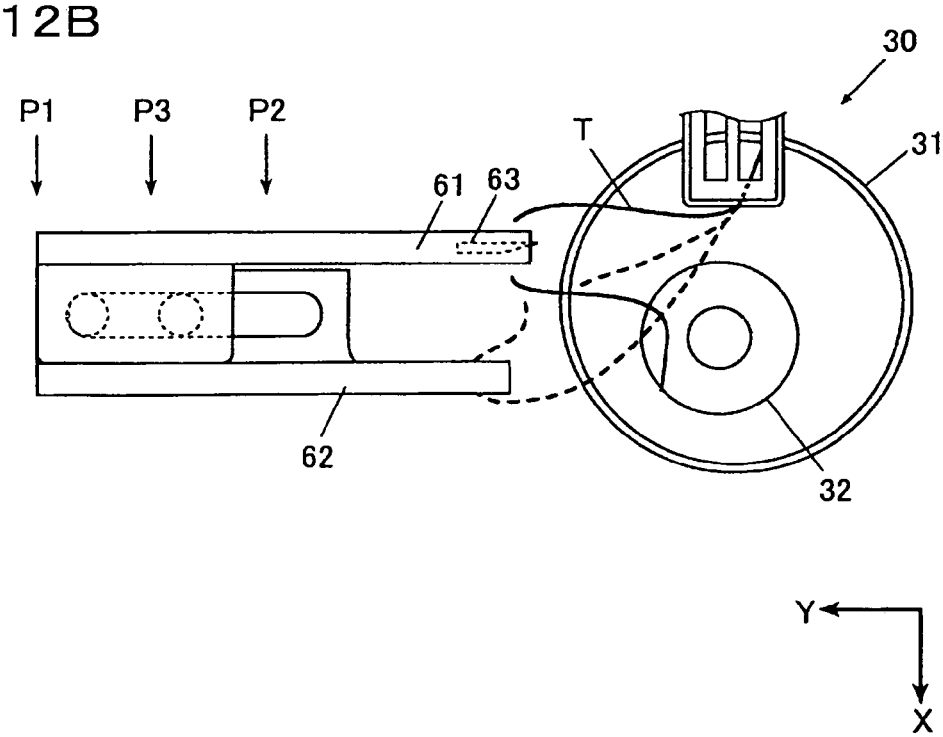

As described above, the rotating speed of the horizontal shaft 30 (the outer shuttle 31*a*) is twice as fast as the rotating speed of the lower shaft 2. Therefore, when the lower shaft 2 rotates by approximately 180 degrees (i.e., a half rotation), the horizontal shuttle 30 (the outer shuttle 31*a*) rotates by approximately 360 degrees (i.e., a full rotation). As shown in FIG. 11B, during the half rotation of the lower shaft 2 and the thread cutting cam 65, the upper thread passing through the outer shuttle 31*a* is caught by the catching base 62 (Step S11). When the end face cam portion 65*a* of the thread cutting cam 65 is rotated to a position at which it abuts against the engaging portion 67*a* as shown in FIG. 11A, the engaging portion 67*a* (the follower in relation to the end face cam portion 65*a* of the thread cutting cam 65 to be the driver) is moved in a leftward direction along the end face cam portion 65*a* as shown in FIG. 12A. Consequently, the thread catching member 61 passes through the thread cutting position P3 and is further moved backward so that the upper thread and the lower thread T are cut by a cooperation of the thread catching member 61 and the fixed knife 63 as shown in FIG. 12B.

Figure 13A:
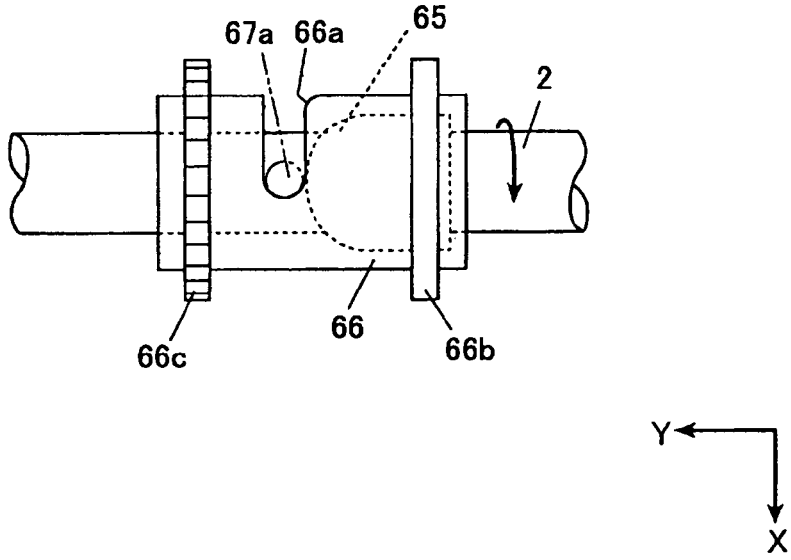
FIGS. 13A and 13B are views illustrating a state in which the thread catching member is moved to its initial position by rotations of a thread cutting cam and the catching portion driving cam.
Figure 13B:
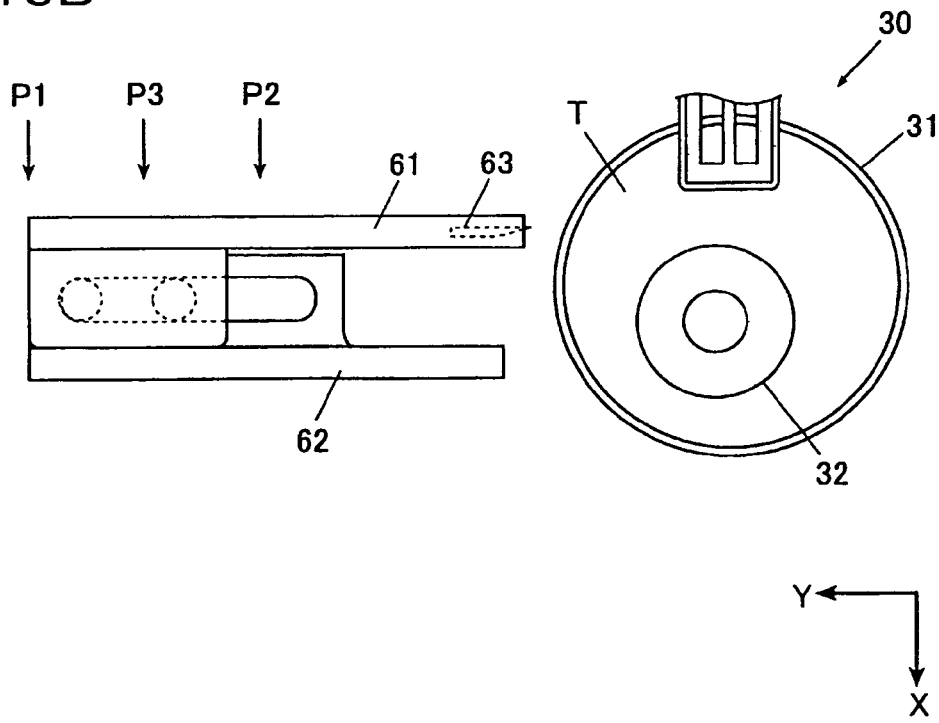
Figure 14A:
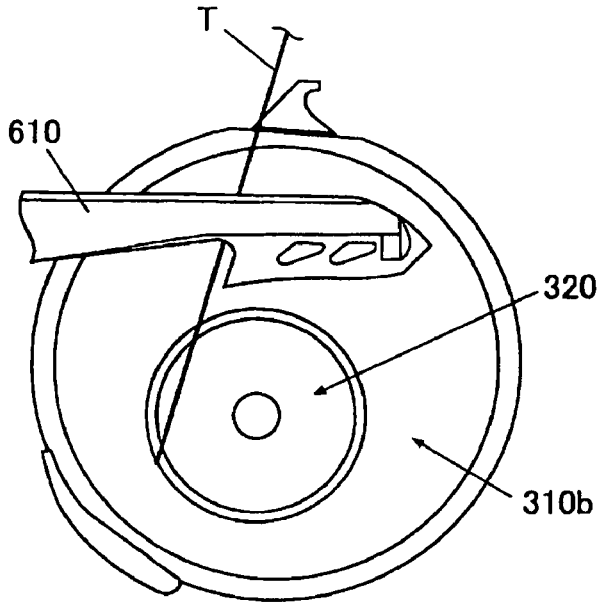
FIG. 14A is a view showing a state in which a thread not yet caught in a thread cutting device according to the related art.
Figure 14B:
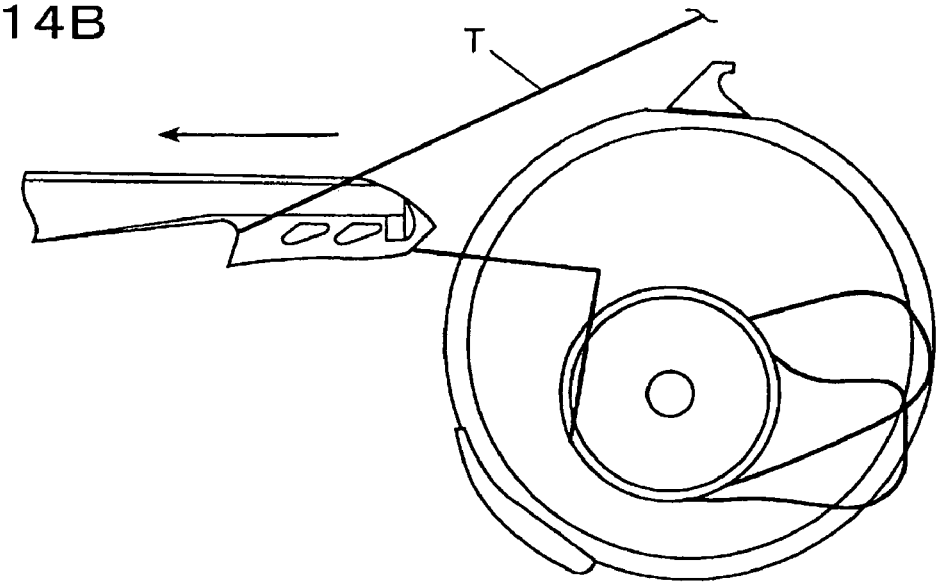
FIG. 14B is a view showing a state in which a thread is caught in a thread cutting device according to the related art.

When the lower shaft 2 and the thread cutting cam 65 are rotated by 180 degrees as shown in FIG. 13A, the engaging portion 67*a* (the follower) is guided to the tip of the thread cutting cam 65 so that the thread catching member 61 is moved backward to its initial position (i.e. in the vicinity of the standby position P1. Thereafter, the CPU 101 executes a processing of driving the thread catching member driving stepping motor 64 through the driving circuit 109 to an original position in a reverse direction (a returning direction) (Step S13). Consequently, the catching portion driving cam 66 is rotated to the initial position in the reverse direction. Accordingly, the engaging portion 67*a* is guided into the standby position 66*d* of the end face cam portion 66*a*. The thread catching member 61 carries out the rest of the backward movement and is moved to the standby position P1 as shown in FIG. 13B (Step S14). Subsequently, the catching portion driving cam 66 is further rotated to an initial position (0 degree) (Step S15), and the thread cut process is ended.

SECOND EXEMPLARY EMBODIMENT

Hereinafter, description will be given to a thread cutting mechanism 260 according to a second exemplary embodiment.

Figure 15:
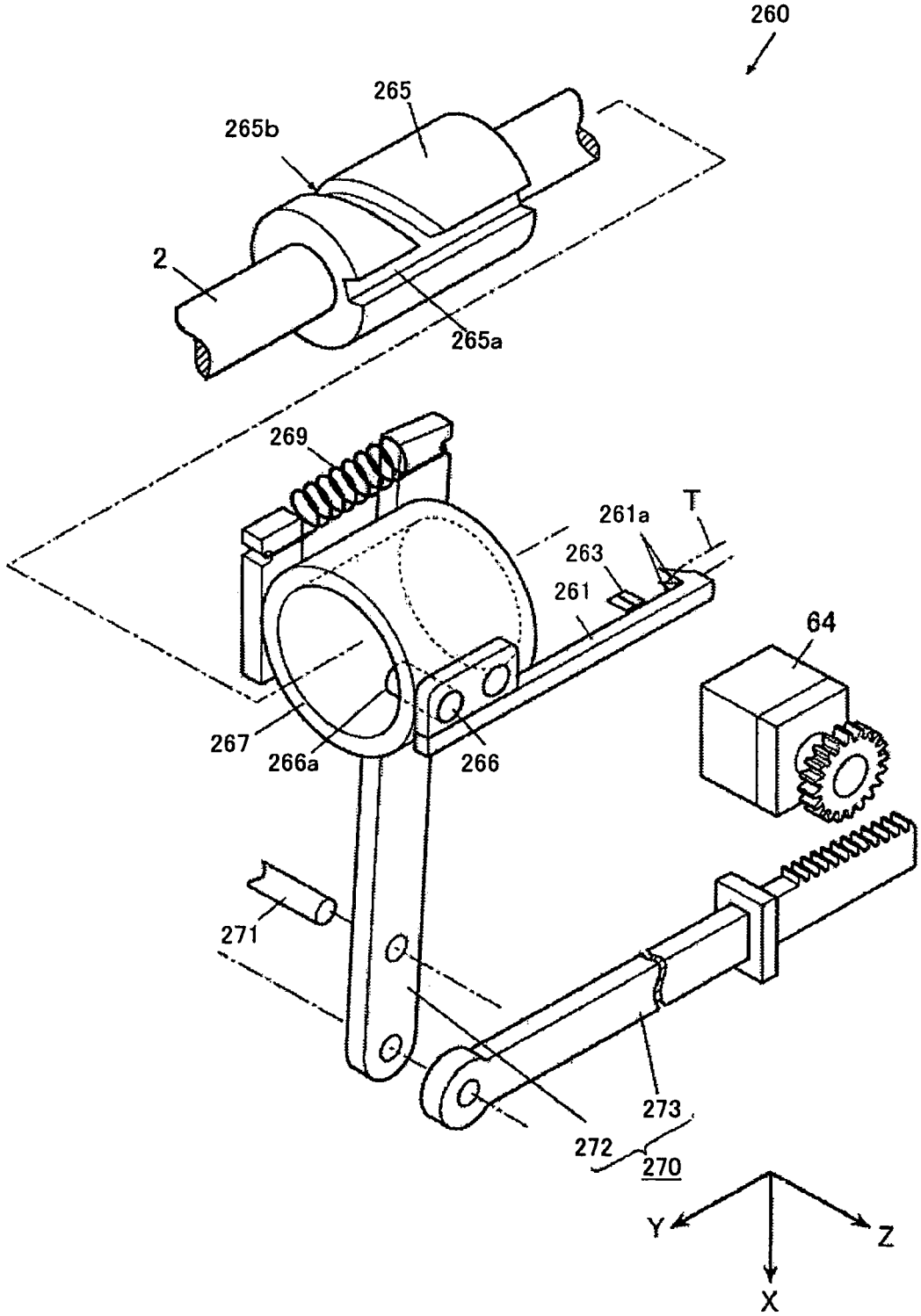
FIG. 15 is an exploded perspective view showing a structure of a thread cutting device according to a second exemplary embodiment.
Figure 16:
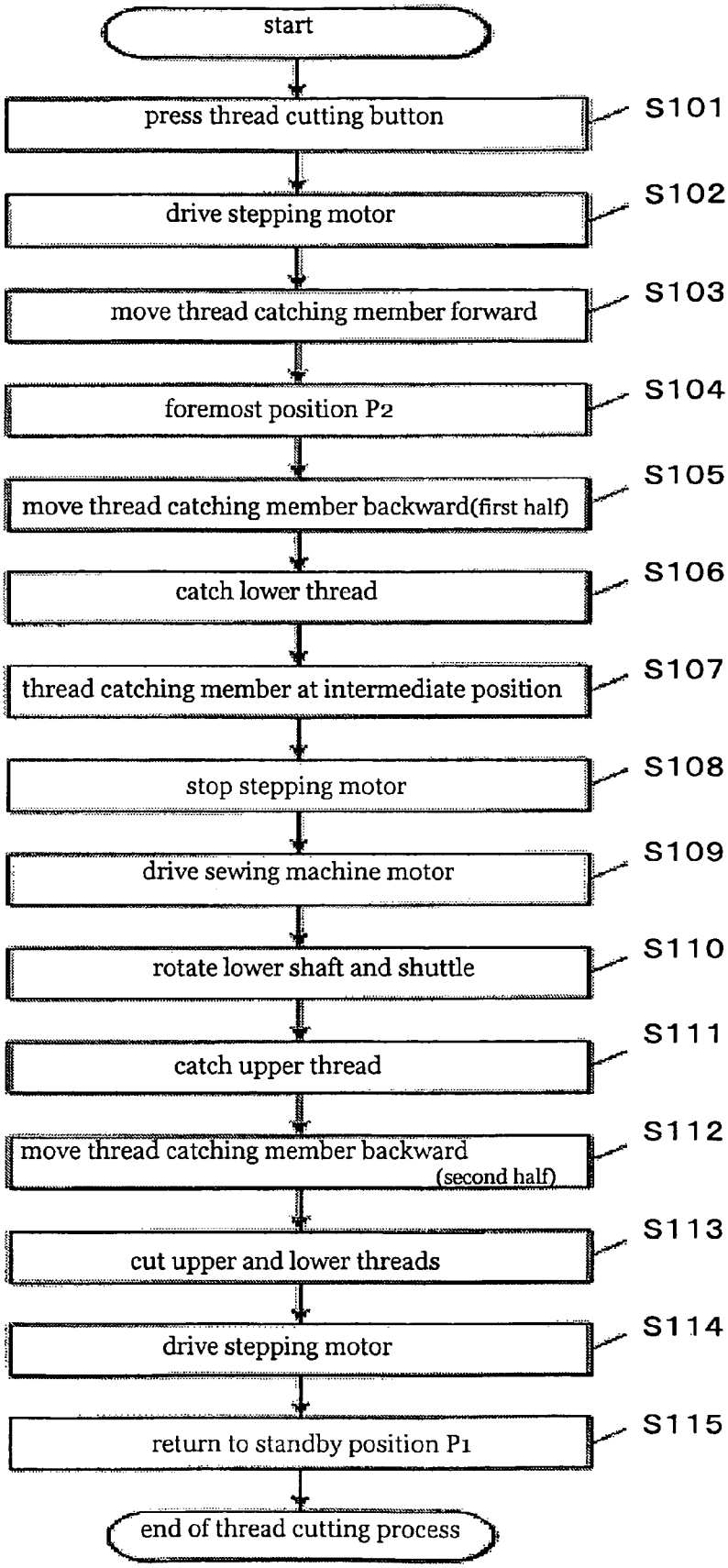
FIG. 16 is a flowchart showing an operation of the thread cutting device according to the second exemplary embodiment.

As shown in FIG. 15, the thread cutting mechanism 260 includes a thread catching member 261 (thread catching means) having a cross section of a C-shape. The thread catching member 261 includes a forked thread catching portion 261*a* protruding from upper and lower parallel surfaces of the C shape at a tip portion thereof. When the thread catching member 261 reciprocates along a longitudinal direction thereof, the thread catching portion 261*a* moves back and forth across a path for a lower thread T reeled out from a bobbin 32 (see FIG. 17) to catch the lower thread T and to move the lower thread T toward a fixed knife 263, thereby cutting the lower thread T together with the fixed knife 263. The fixed knife 263 is fixed at a level between the forked thread catching portion 261*a*. The thread cutting mechanism 260 further includes an operating member 267 (first power transmitting portion, first power transmitting means) to which a base end of the thread catching member 261 is fixed and transmit a power, a spring 269 (biasing means) which applies force to the thread catching member 261 in a forward direction of the back and forth movement, a thread cutting cam 265 (a cam member) which is provided on a lower shaft 2 rotated by a sewing machine motor 5 and transmits a moving force to the thread catching member 261 through the operating member 267, a thread catching member driving stepping motor 64 (a stepping motor) for driving the thread catching member 261, and a second power transmitting portion (second power transmitting means) 270 which transmits a moving force from the thread catching member driving stepping motor 64 to the thread catching member 261 through the operating member 267.

The base end of the thread catching member 261 is fixed to an outer circumference of the operating member 267 through a pin 266. The thread catching member 261 is movable back and forth along the Y-axis direction relative to the fixed knife 263 fixed inside a bed portion 12.

The operating member 267 is a cylindrical moving member and is disposed such that a thrust direction thereof is set along a Y-axis direction. The thread catching member 261 is fixed to the outer circumference of the operating member 267 in the Y-axis direction. According to the second exemplary embodiment, a part of the pin 266 (hereinafter referred to as a projection 266*a*), which couples the thread catching member 261 and the operating member 267, is protruded toward an inner side of the operating member 267.

The projection 266*a* is a follower according to the second exemplary embodiment and is engageable with a straight groove portion 265*a* or a spiral groove portion 265*b* which act as drivers of the thread cutting cam 265. The projection 266*a* is guided by the groove portions 265*a*, 265*b*.

The thread cutting cam 265 fixed to the lower shaft 2 is inserted into the operating member 267, and the operating member 267 is movable along the Y-axis direction. One end of the spring 269 is coupled to the operating member 267, and the spring 269 constantly biases the thread catching member 261 in a direction of a forward movement of the thread catching member 261. Accordingly, the projection 266*a* of the operating member 267 is constantly biased in a direction in which the projection 266*a* abuts against the driver (the spiral groove portion 265*b*) of the thread cutting cam 265.

The thread cutting cam 265 is fixed to the lower shaft 2. An outer circumference of the thread cutting cam 265 is formed with a groove portion (the straight groove portion 265*a*) which is straight along a thrust direction of the lower shaft 2, and another groove portion (the spiral groove portion) which extends from a central part of the straight groove portion 265*a* to one end the thread cutting cam 265.

When the projection 266*a* is engaged with the straight groove portion 265*a*, the thread catching member 261 can move between a rearmost position (a standby position P1) to a foremost position P2.

Figure 17:
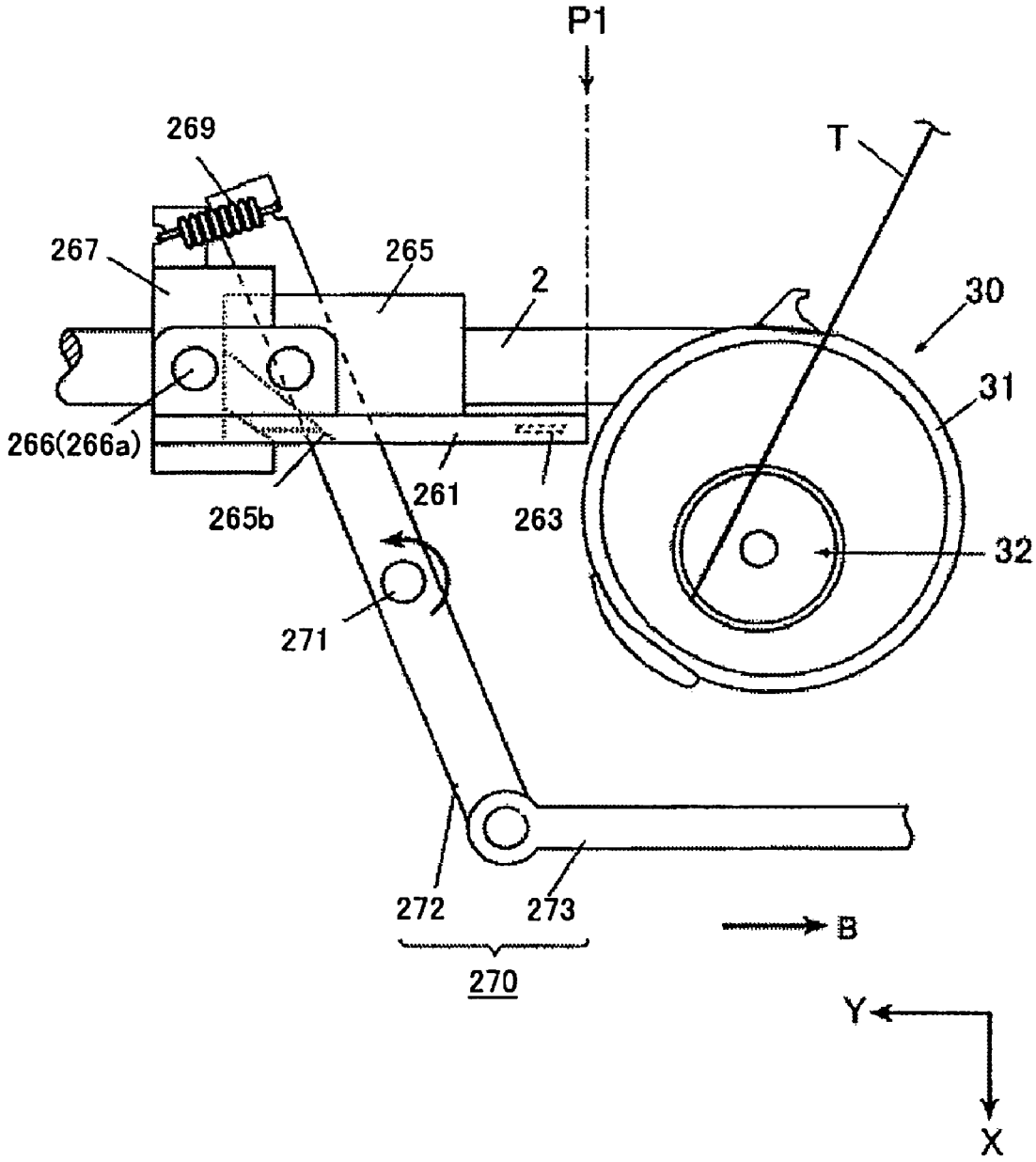
FIG. 17 is a view illustrating an operation of the thread cutting device of the sewing machine according to the second exemplary embodiment.

In a case in which the projection 266*a* (the follower) of the operating member 267 is engaged with the spiral groove portion 265*b*, the protrusion 266*a* is moved backward along the spiral groove portion 265*b* and is guided to an end face of the thread cutting cam 265 on a rear side in the back and forth movement of the thread catching member 261, whereby the thread catching member 261 is positioned at the rearmost position (i.e., the standby position P1) in its back and forth movement (see FIG. 17). Namely, the spiral groove portion 265*b* functions as the driver of the thread cutting cam 265 in the second exemplary embodiment.

The thread catching member driving stepping motor 64 is disposed on a rear side inside the bed portion 12. As shown in FIG. 15, the thread catching member driving stepping motor 64 is coupled through a gear (a pinion) attached an output shaft thereof to the second power transmitting portion 270.

The second power transmitting portion 270 includes link members 272, 273. The other end of the spring 269 is coupled to one end of the link member 272 in a longitudinal direction thereof, and one end of the link member 273 is rotatably coupled to the other end of the link member 272. A central part in the longitudinal direction of the link member 272 is supported rotatably by a support shaft 271 fixed inside the bed portion 12.

The link member 273 extends in a longitudinal direction (Y-axis direction) of the bed portion 12 inside the bed portion 12, and the other end of the link member 273, on which a rack is formed, is coupled to the thread catching member driving stepping motor 64.

When the thread catching member driving stepping motor 64 is driven, the operating member 267 is moved back and forth through the link members 272, 273. As a result, the thread catching member 261 can be moved back and forth. As for an amount of a driving operation of the thread catching member driving stepping motor 64 corresponding to an amount of the back and forth movement of the thread catching member 261, the numbers of pulses corresponding to various amount of the back and forth movement are experimentally obtained in advance and are stored in an ROM 102 which is a storing portion of a control portion 100.

(Control System of Sewing Machine)

The control portion 100 (a cutting control unit or cutting control means according to the second exemplary embodiment) drives the thread catching member driving stepping motor 64 to move the thread catching member 261 through the link members 272, 273 of the second power transmitting portion 270 so as to catch the lower thread T, and then drives the sewing machine motor 5 to move the thread catching member 261 through the thread cutting cam 265 so as to cut the lower thread T.

Namely, the control portion 100 executes, as the cutting control means, a processing of driving the thread catching member driving stepping motor 64, thereby moving the thread catching member 61 through link members 272, 273 and the operating member 267 to catch the lower thread T, and then driving the sewing machine motor 5, thereby moving the thread catching member 261 through the thread cutting cam 265 and the operating member 267 to cut the lower thread T. According to the second exemplary embodiment, when the pressing operation to the thread cutting button 80 (the thread cut starting switch) is detected, the CPU 101 reads a detection signal from the spindle position detecting sensor 19, and the operation processing is carried out by the control portion 100 when the lower shaft 2 is positioned at a predetermined rotating angle (for example, an angle of the lower shaft at which the needle bar is stopped at its lower position).

(Operation According to Second Exemplary Embodiment)

Next, an operation of the sewing machine 1 having the above configuration will be described with reference to a flowchart of FIG. 16 and FIGS. 17 to 21.

As shone in FIG. 17, during a sewing work, the link 273 is held by the thread catching member driving stepping motor 64 in a direction B, and stands by in a state in which the thread catching member 261 is positioned at the rearmost position P1. At this time, the projection 266*a* is disposed at a position in which it is not engaged with the end of the thread cutting cam 265. Therefore, the projection 266*a* and the thread cutting cam 265 do not interfere with each other so that the lower shaft 2 and the thread cutting cam 265 can be freely rotated.

Figure 18:
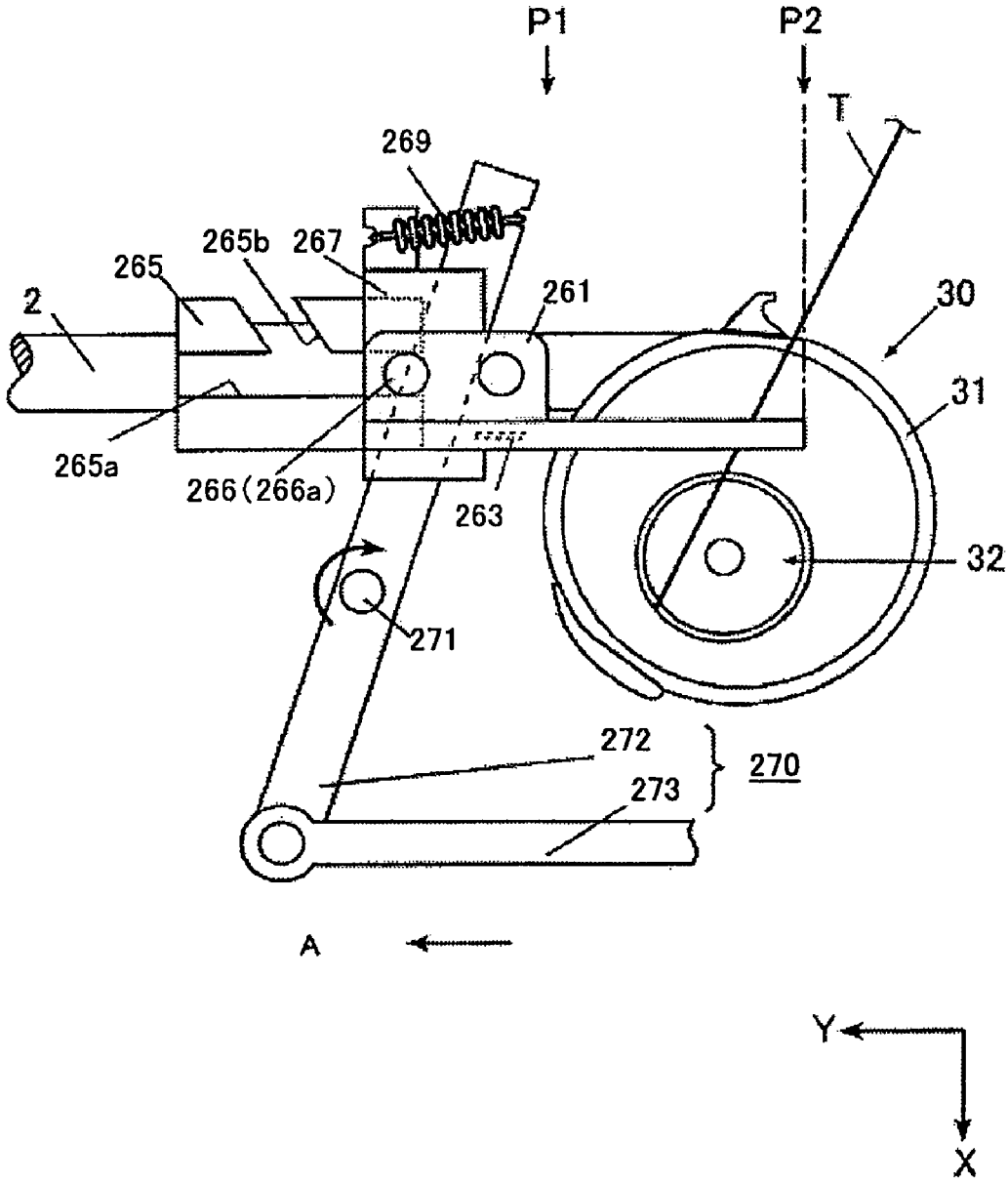
FIG. 18 is another view illustrating the operation of the thread cutting device according to the second exemplary embodiment.

When the sewing work is ended, the sewing machine motor 5 is stopped so that the upper shaft and the lower shaft 2 are stopped in a state in which a needle 21 is stopped at its lower position. At this time, the thread cutting cam 265 is stopped with the straight groove portion 265*a* disposed in an upper part as shown in FIG. 18. Accordingly, a space is ensured for a tip of the projection 266*a* move to a position at which the thread catching member 261 is moved to the foremost position P2 when the operating member 267 is moved. At this stage, the thread catching member 261 is still positioned at the standby position P1.

Figure 19:
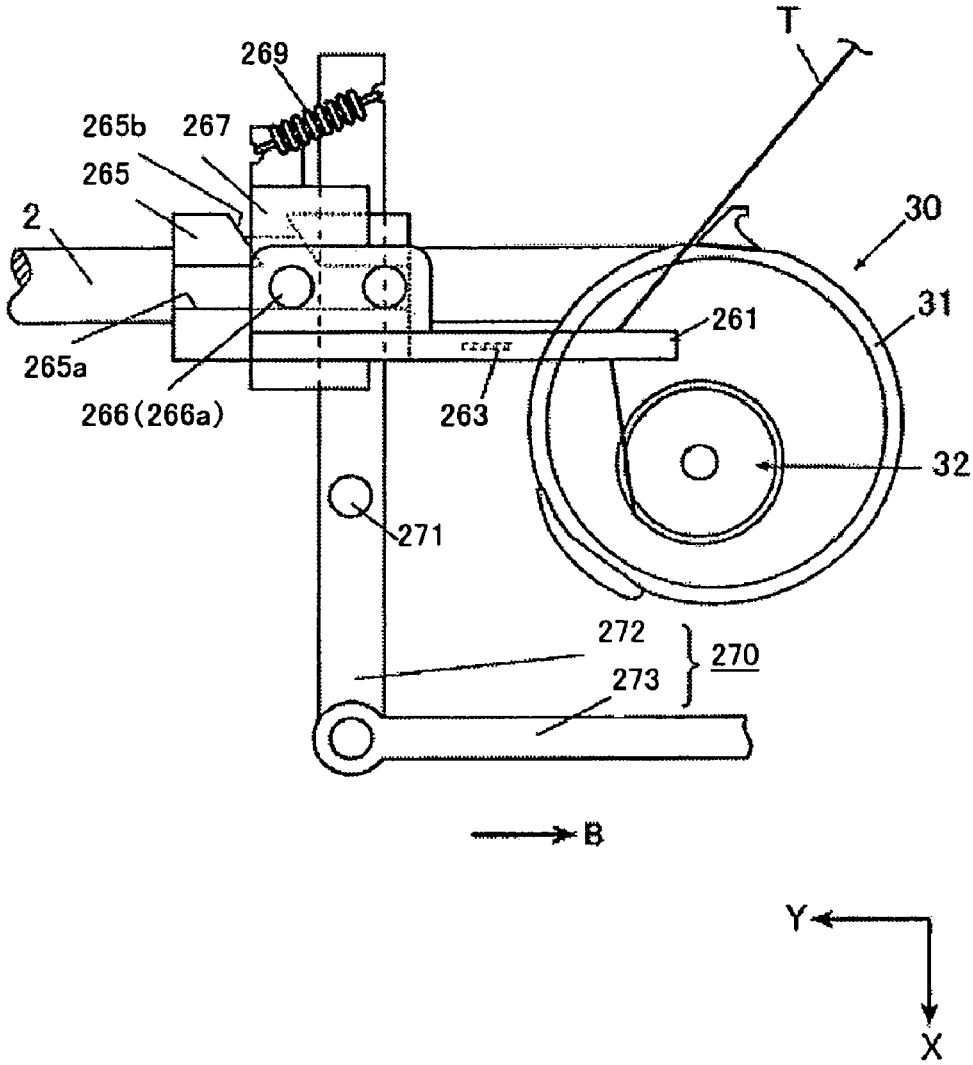
FIG. 19 is another view illustrating the operation of the thread cutting device according to the second exemplary embodiment.

When the thread cutting button 80 is pressed (Step S101), the CPU 101 executes a processing of driving the thread catching member driving stepping motor 64 through a driving circuit 109 (Step S102) to move the link member 273 in a direction A. Consequently, the projection 266*a* of the operating member 267 coupled to the link member 272 through the spring 269 is moved in a rightward direction in FIG. 18 along the straight groove portion 265*a* so that the thread catching member 261 is moved in a forward direction (Step S103). As shown in FIG. 18, when the thread catching member 261 is moved to the foremost position P2 (Step S104), the CPU 101 executes a processing of rotating the thread catching member driving stepping motor 64 through the driving circuit 109 at a low speed in a reverse direction to move the link member 273 in the direction B, thereby moving the thread catching member 261 backward at a low speed (Step S105). Consequently, the thread catching member 261 moves backward at a low speed so that the lower thread T is caught by the thread catching portion 261*a* (Step S106), and the lower thread T is slowly pulled out from the bobbin 32. As shown in FIG. 19, when the operating member 267 is moved backward to an intermediate position of the straight groove portion 265*a* at which one end of the spiral groove portion 265*b* is arranged (Step S107), the CPU 101 executes a processing of stopping the thread catching member driving stepping motor 64 through the driving circuit 109 (Step S108) and driving the sewing machine motor 5 through a driving circuit 106 (Step S109).

Figure 20:
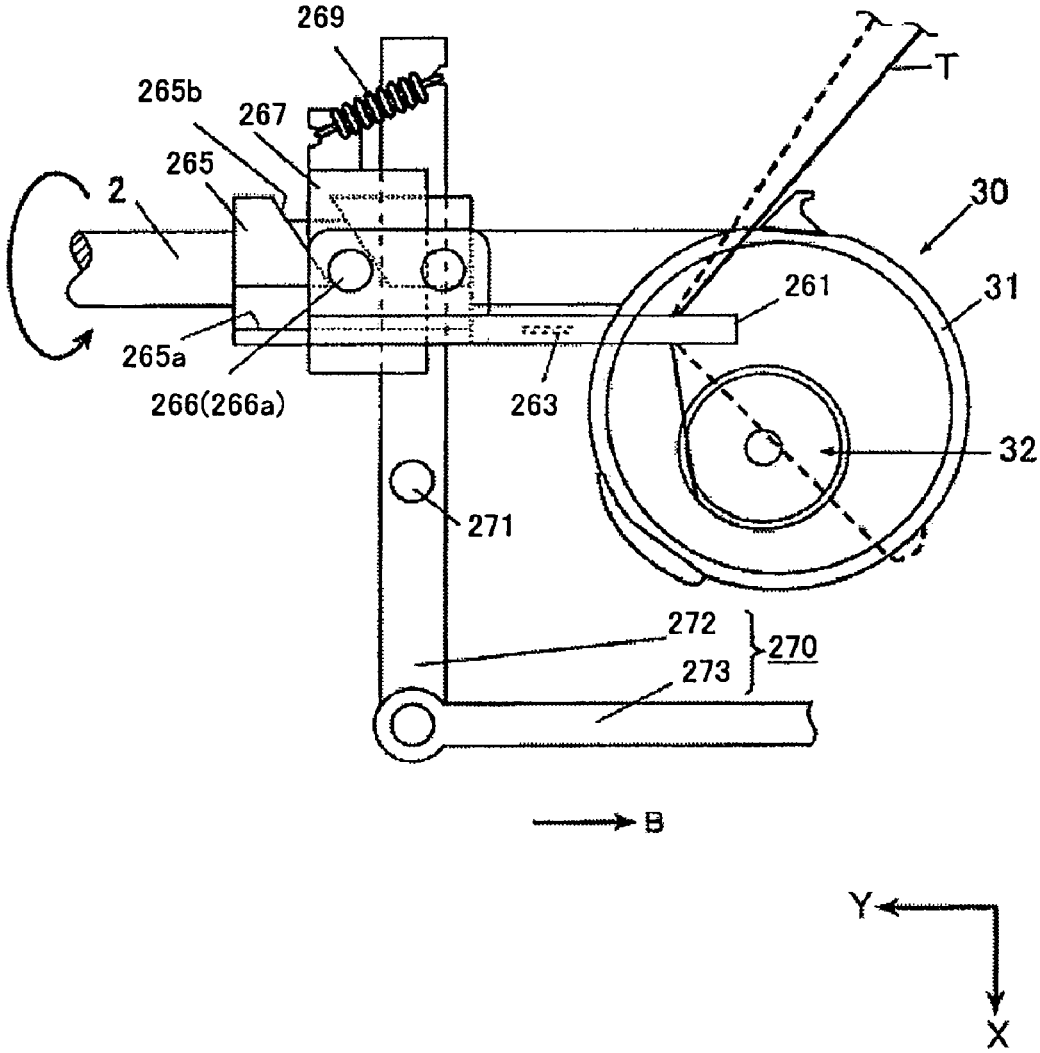
FIG. 20 is another view illustrating the operation of the thread cutting device according to the second exemplary embodiment.
Figure 21:
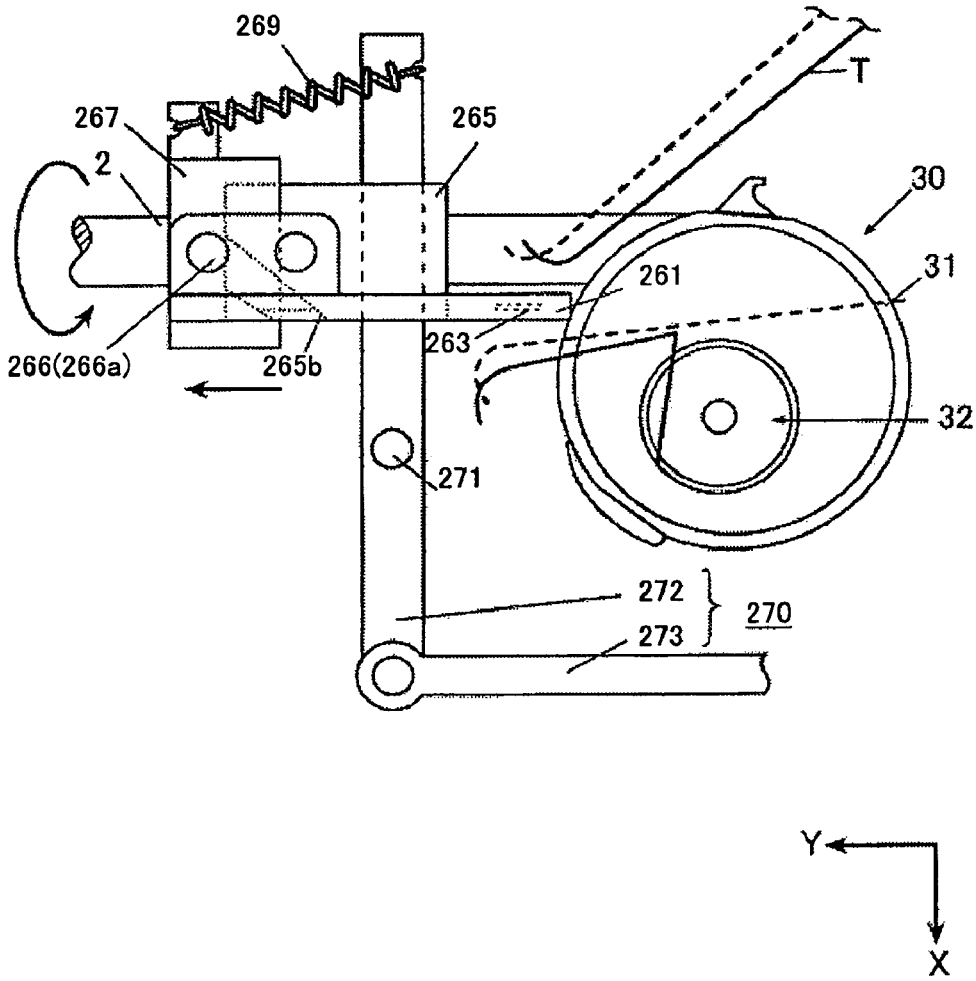
FIG. 21 is another view illustrating the operation of the thread cutting device according to the second exemplary embodiment.

When the sewing machine motor 5 is driven, the lower shaft 2 and the thread cutting cam 265 are rotated so that a horizontal shuttle 30 (an outer shuttle 31*a*) coupled to the lower shaft 2 is rotated as shown in FIGS. 20 and 21 (Step S110).

As described above, the rotating speed of the horizontal shuttle 30 (the outer shuttle 31*a*) is twice as fast as the rotating speed of the lower shaft 2. Therefore, when the lower shaft 2 rotates by approximately 180 degrees (i.e., a half rotation), the horizontal shuttle 30 (more specifically, the outer shuttle 31*a*) rotates by approximately 360 degrees (i.e., a full rotation). During the half rotation of the lower shaft 2 and the thread cutting cam 265, as shown in FIG. 20, the upper thread passing through the outer shuttle 31*a* is caught by the thread catching portion for the upper thread (Step S111). When the thread cutting cam 265 is further rotated as shown in FIG. 21, the projection 266*a* (the follower in relation to the spiral groove portion 265*b* of the thread cutting cam 265 to be the driver) is moved in a leftward direction of FIG. 21 along the spiral groove portion 265*b*. Consequently, the thread catching member 261 is further moved in a backward direction (Step S112) and the upper thread and the lower thread T are cut by a cooperation of the thread catching member 261 and the fixed knife 263 (Step S113).

When the lower shaft 2 and the thread cutting cam 265 are rotated by 180 degrees, the projection 266*a* (the follower) is moved out of the spiral groove portion 265*b*. Thereafter, the CPU 101 executes a processing of driving the thread catching member driving stepping motor 64 through the driving circuit 109 to an original position in a reverse direction (a returning direction) (Step S114). Consequently, the link member 273 is moved to its initial position in the direction B, whereby the projection 266*a* is moved apart from the end of the thread cutting cam 265 and is moved to the initial position (i.e., the standby position P1) (Step S115), and the thread cut processing is thus ended.

According to the first exemplary embodiment, the thread catching member 61 can be moved with low speed by using the thread catching member driving stepping motor 64 (the stepping motor) as the driving source for the thread catching member 61 when catching the lower thread T. Consequently, it is possible to prevent the lower thread T from being excessively pulled out from the bobbin 32. In addition, the cutting force can be increased as compared with a case in which the stepping motor is employed as the driving source to cut the threads by using the sewing machine motor 5 as the driving source for the thread catching member 61 when cutting the lower thread T. Accordingly, it is possible to execute the thread cutting operation without considering a type of the thread to be used (e.g., a thickness and hardness), thereby preventing a failure in thread cutting. Namely, the thread cutting device (the thread cutting mechanism 60) according to the first exemplary embodiment can smoothly catch and cut the lower thread T while preventing both the excessive pull-out of the lower thread T and the thread cutting failure.

More specifically, the engaging portion 67*a* (the follower) of the catching portion operating link 67 can be moved backward to a position at which it is not engaged with the driver (the end face cam portion 65*a*) of the thread cutting cam 65 by the driver (the end face cam portion 66*a*) of the catching portion driving cam 66. Therefore, during the sewing work, the end face cam portion (the driver) of the thread cutting cam 65 rotating together with the lower shaft 2 does not interfere with the engaging portion (the follower) of the catching portion operating link 67. Thus, a smooth sewing operation can be implemented.

Furthermore, the catching portion driving cam 66 accommodates the thread cutting cam 65 therein. Therefore, it is possible to smoothly catch and cut the lower thread T with a simple structure while saving a space to be occupied by the thread cutting mechanism 60.

According to the second exemplary embodiment, the control portion 100 (the cutting control unit, the cutting control means) drives the stepping motor 64 when the pin 266 (the projection 266*a*), which is the follower of the operating member 267, is engaged with the straight groove portion 265*a* being a permitting portion of the thread cutting cam 265, which is the cam member (the rotating cam), so that the thread catching member 261 is moved back and forth through the link members 272, 273 so as to catch the lower thread T. By employing the thread catching member driving stepping motor 64 as the driving source for the thread catching member 261 when catching the lower thread T, it is possible to move the thread catching member 261 at a low speed. Consequently, it is possible to prevent the lower thread T from being excessively pulled out from the bobbin 32.

In addition, the control portion 100 drives the sewing machine motor 5 after the lower thread T is caught when the projection 266*a*, which is the follower of the moving member 267, is engaged with the spiral groove portion 265, which is an abutting portion of the thread cutting cam 265, so that the thread catching member 261 is moved back and forth through the thread cutting cam 265 so as to cut the lower thread T. The cutting force can be increased as compared with a case in which the stepping motor is employed as the driving source to cut the threads by using the sewing machine motor 5 as the driving source for the thread catching member 261 when cutting the lower thread T. Accordingly, it is possible to execute the thread cutting operation without considering a type of the thread to be used (e.g., a thickness and hardness), thereby preventing a failure in thread cutting. Namely, the thread cutting device (the thread cutting mechanism 60) according to the first exemplary embodiment can smoothly catch and cut the lower thread T while preventing both the excessive pull-out of the lower thread T and the thread cutting failure.

While the thread catching member driving stepping motor 64 is driven in response to an input of a thread cutting signal by pressing the thread cutting button 80 in the exemplary embodiments, it is also possible to provide detecting means, such as a sensor, for detecting that the lower shaft 2 is positioned at a predetermined rotating angle so that the control portion 100 controls the thread catching member driving stepping motor 64 in response to a detection signal sent from the sensor. The control portion 100 may sequentially execute the thread cutting operation by driving the thread catching member driving stepping motor 64 and the sewing machine motor 5 when ending the sewing work based on preset sewing data.

Moreover, the biasing means may be a rubber in so far as the biasing means biases the thread catching member 61, 261 in the forward moving direction and may be a rubber.

According to the first exemplary embodiment, the gear 73 and the gear 66*c* are directly meshed with each other to save the space for the rotation transmitting means (the second power transmitting portion, the second power transmitting means) inside the bed portion 12. However, in so far as the rotation transmitting means transmits a rotation to the catching portion driving cam 66 corresponding to the amount of the rotation of the thread catching member driving stepping motor 64, the rotation may be transmitted from the gear 73 through a belt or a rack (a pinion) to the catching portion driving cam 66, thereby desirably arranging the rotation transmitting means in accordance with the space inside the bed portion 12.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A thread cutting device of a sewing machine, the thread cutting device comprising:

a thread catching member having a catching portion, wherein the thread catching member moves back and forth across a path of a lower thread reeled out from a bobbin so as to catch the lower thread by the catching portion, and cuts the lower thread by cooperating with a fixed knife;

a first power transmitting portion which transmits a power to the thread catching member;

a sewing machine motor operable to rotate a lower shaft;

a first cam member provided on the lower shaft, wherein the first cam member transmits a first moving force to the thread catching member through the first power transmitting portion;

a stepping motor operable to drive the thread catching member;

a second power transmitting portion which transmits a second moving force from the stepping motor to the thread catching member through the first power transmitting portion; and a cutting control unit operable to drive the stepping motor to move the thread catching member through the second power transmitting portion when catching the lower thread, and to drive the sewing machine motor to move the thread catching member through the first cam member when cutting the lower thread.

2. The thread cutting device according to claim 1, wherein the second power transmitting portion includes a second cam member which is operated by the stepping motor, the first power transmitting portion has a follower adapted to abut against drivers of the first cam member and the second cam member, and the driver of the second cam member is operable to move the thread catching member backward and to move the follower to a position at which the driver of the first cam member is disengaged from the follower.

3. The thread cutting device according to claim 1, wherein the first cam member includes an end face cam, wherein the driver of the first cam member is on an end face of the first cam member with respect to a thrust direction of the lower shaft, and the second cam member is a cylindrical cam inside which the first cam member is accommodated.

4. The thread cutting device according to claim 2, wherein the first cam member includes an end face cam, wherein the driver of the first cam member is on an end face of the first cam member with respect to a thrust direction of the lower shaft, and the second cam member is a cylindrical cam inside which the first cam member is accommodated.

5. The thread cutting device according to claim 1, wherein the first power transmitting portion includes an operating member having a follower adapted to engage with the first cam member, wherein the operating member moves back and forth to move the thread catching member back and forth, and the first cam member includes a rotating cam which is rotated by the lower shaft, wherein the rotating cam includes a permitting portion which allows the follower to move back and forth and an abutting portion which moves the follower backward in accordance with a rotating angle of the rotating cam.

6. The thread cutting device according to claim 5, wherein the permitting portion has a straight groove portion formed on a circumferential surface of the first cam member along a thrust direction of the lower shaft, and the abutting portion has a spiral groove portion formed along the peripheral surface of the first cam member from a central part of the straight groove portion to one end of the first cam member in the thrust direction.

7. A thread cutting device of a sewing machine, the thread cutting device comprising:

a thread catching for catching and cutting a lower thread by moving back and forth across a path of a lower thread reeled out from a bobbin;

a first power transmitting means for transmitting a power to the thread catching means;

a first drive source operable to rotate a lower shaft;

a first cam member provided on the lower shaft, wherein the first cam member transmits a first moving force to the thread catching means through the first power transmitting means;

a second drive source operable to drive the thread catching means;

a second power transmitting means for transmitting a second moving force from the second drive source to the thread catching means through the first power transmitting means; and a cutting control means for driving the second drive source to move the thread catching means through the second power transmitting means when catching the lower thread, and for driving the first drive source to move the thread catching means through the first cam member when cutting the lower thread.

8. The thread cutting device according to claim 7, wherein the second power transmitting means includes a second cam member which is operated by the second drive source, the first power transmitting means has a follower adapted to abut against drivers of the first cam member and the second cam member, and the driver of the second cam member is operable to move the thread catching means backward and to move the follower to a position at which the driver of the first cam member is disengaged from the follower.

9. The thread cutting device according to claim 7, wherein the first cam member includes an end face cam, wherein the driver of the first cam member is on an end face of the first cam member with respect to a thrust direction of the lower shaft, and the second cam member is a cylindrical cam inside which the first cam member is accommodated.

10. The thread cutting device according to claim 8, wherein the first cam member includes an end face cam, wherein the driver of the first cam member is on an end face of the first cam member with respect to a thrust direction of the lower shaft, and the second cam member is a cylindrical cam inside which the first cam member is accommodated.

11. The thread cutting device according to claim 7, wherein the first power transmitting means includes an operating member having a follower adapted to engage with the first cam member, wherein the operating member moves back and forth to move the thread catching means back and forth, and the first cam member includes a rotating cam which is rotated by the lower shaft, wherein the rotating cam includes a permitting portion which allows the follower to move back and forth and an abutting portion which moves the follower backward in accordance with a rotating angle of the rotating cam.

12. The thread cutting device according to claim 11, wherein the permitting portion has a straight groove portion formed on a circumferential surface of the first cam member along a thrust direction of the lower shaft, and the abutting portion has a spiral groove portion formed along the peripheral surface of the first cam member from a central part of the straight groove portion to one end of the first cam member in the thrust direction.

* * * * *